US008651044B2

(12) United States Patent
Ichimura et al.

(10) Patent No.: US 8,651,044 B2
(45) Date of Patent: Feb. 18, 2014

(54) IMAGE FORMING APPARATUS AND APPARATUS FOR COATING FOAM ON COATING TARGET MEMBER

(75) Inventors: Minori Ichimura, Tokyo (JP); Yasuhisa Kato, Kanagawa (JP); Kazuyoshi Matsumoto, Tokyo (JP); Manabu Izumikawa, Tokyo (JP); Yasuo Katano, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 424 days.

(21) Appl. No.: 12/670,075

(22) PCT Filed: Sep. 11, 2008

(86) PCT No.: PCT/JP2008/066900

§ 371 (c)(1),
(2), (4) Date: Jan. 21, 2010

(87) PCT Pub. No.: WO2009/035137

PCT Pub. Date: Mar. 19, 2009

(65) Prior Publication Data

US 2010/0218718 A1 Sep. 2, 2010

(30) Foreign Application Priority Data

Sep. 14, 2007 (JP) ..... 2007-238823
Sep. 3, 2008 (JP) ..... 2008-226487

(51) Int. Cl.

| | |
|---|---|
| ***B05C 1/08*** | (2006.01) |
| ***B05C 1/02*** | (2006.01) |
| ***B05C 1/00*** | (2006.01) |
| ***B05C 13/00*** | (2006.01) |
| ***B05C 9/14*** | (2006.01) |
| ***B05C 9/08*** | (2006.01) |
| ***B05C 9/00*** | (2006.01) |
| ***B05C 11/10*** | (2006.01) |
| ***B05C 11/00*** | (2006.01) |

(52) U.S. Cl.
USPC ..... 118/258; 118/58; 118/256; 118/200

(58) Field of Classification Search
USPC ..... 118/258
See application file for complete search history.

(56) References Cited

U.S. PATENT DOCUMENTS 5,175,568 A 12/1992 Oyamaguchi et al.
5,175,569 A 12/1992 Chiba (Continued)

FOREIGN PATENT DOCUMENTS

JP 55-122972 2/1979
JP 59-62366 4/1984

(Continued)

OTHER PUBLICATIONS

Feb. 24, 2011 Chinese official action (with English translation) in connection with a counterpart Chinese patent application.

(Continued)

*Primary Examiner* — Dah-Wei Yuan
*Assistant Examiner* — Jethro Pence
(74) *Attorney, Agent, or Firm* — Cooper & Dunham LLP

(57) ABSTRACT

An image forming apparatus includes a generating mechanism to generate foam from a liquid or gel which may take a foam state, a coating roller having a peripheral surface supplied with the foam to coat the foam on the peripheral surface onto a surface of a recording medium, and a transport passage to transport the foam from the generating mechanism to the coating roller by an accumulation force of the foam.

15 Claims, 22 Drawing Sheets

(56) References Cited

U.S. PATENT DOCUMENTS

| | | | | |
|---|---|---|---|---|
| 5,177,506 | A | 1/1993 | Katano | |
| 5,200,762 | A | 4/1993 | Katano et al. | |
| 5,278,126 | A | 1/1994 | Katano et al. | |
| 5,335,001 | A | 8/1994 | Katano | |
| 5,369,421 | A | 11/1994 | Tomono et al. | |
| 5,436,642 | A | 7/1995 | Oyamaguchi et al. | |
| 5,471,234 | A | 11/1995 | Katano et al. | |
| 5,771,054 | A | 6/1998 | Dudek et al. | |
| 6,084,620 | A | 7/2000 | Morikawa et al. | |
| 6,108,021 | A | 8/2000 | Morikawa et al. | |
| 6,161,928 | A | 12/2000 | Morikawa et al. | |
| 6,183,079 | B1 | 2/2001 | Meade et al. | |
| 6,257,716 | B1 | 7/2001 | Yanagawa et al. | |
| 6,402,314 | B1 * | 6/2002 | Sato et al. | 347/98 |
| 6,402,317 | B2 | 6/2002 | Yanagawa et al. | |
| 6,439,713 | B1 | 8/2002 | Noguchi et al. | |
| 6,589,708 | B1 | 7/2003 | Katano et al. | |
| 6,623,816 | B1 | 9/2003 | Tanikawa et al. | |
| 6,725,777 | B2 | 4/2004 | Katano et al. | |
| 6,837,578 | B2 | 1/2005 | Tanikawa et al. | |
| 6,961,074 | B2 | 11/2005 | Katano et al. | |
| 7,061,513 | B2 | 6/2006 | Katano et al. | |
| 7,070,269 | B2 | 7/2006 | Tanikawa et al. | |
| 7,938,527 | B2 * | 5/2011 | Ohshima et al. | 347/102 |
| 2003/0022106 | A1 | 1/2003 | Katano et al. | |
| 2004/0131402 | A1 | 7/2004 | Kurotori et al. | |
| 2005/0243121 | A1 | 11/2005 | Onishi | |
| 2006/0077243 | A1 | 4/2006 | Edwards | |
| 2008/0063446 | A1 * | 3/2008 | Katano et al. | 399/340 |

FOREIGN PATENT DOCUMENTS

| | | | | |
|---|---|---|---|---|
| JP | 59-69179 | | 4/1984 | |
| JP | 62-292485 | | 12/1987 | |
| JP | 64-34471 | | 2/1989 | |
| JP | 1-164468 | | 6/1989 | |
| JP | 5-309474 | | 11/1993 | |
| JP | 7-266031 | | 10/1995 | |
| JP | 7-286127 | | 10/1995 | |
| JP | 8-46340 | | 2/1996 | |
| JP | 8-323977 | | 10/1996 | |
| JP | 2002-137378 | | 5/2002 | |
| JP | 2004-330569 | | 11/2004 | |
| JP | 2005-138502 | | 6/2005 | |
| JP | WO2007/094245 | * | 8/2007 | G03G 15/20 |
| JP | WO2008/035797 | * | 3/2008 | B41M 5/00 |
| WO | WO2007/094245 | A1 | 8/2007 | |
| WO | WO2008/035797 | * | 3/2008 | B41M 5/00 |

OTHER PUBLICATIONS

European Search Report dated May 8, 2013 in corresponding European patent application No. 08 83 0046.2.

* cited by examiner

IMAGE FORMING APPARATUS AND APPARATUS FOR COATING FOAM ON COATING TARGET MEMBER

TECHNICAL FIELD

The present invention generally relates to image forming apparatuses and apparatuses for coating foam on a coating target member, and more particularly to an image forming apparatus which coats foam on a recording medium on which a recording head forms an image by jetting ink on the recording medium, and to an apparatus which coats the foam on the coating target member.

BACKGROUND ART

A printer, a facsimile machine, a copying machine, a plotter, and a Multi-Function Peripheral (MFP) which combines the functions of two or more of such equipments, may have a recording head which is configured to form an image on a recording medium which is transported, by jetting ink on the recording medium. The recording medium may be formed by any suitable material or member capable of bearing the image thereon. Examples of the recording medium include a transfer member, recording paper, recording sheet and the like. In this specification, "forming the image on the recording medium" refers to any suitable means of making the image on the recording medium, including recording, printing, plotting, transferring and the like.

In this specification, the "image forming apparatus" refers to any apparatus capable of forming the image on the recording medium which may be made of a material such as paper, yarn, fiber, silk screen or cloth, leather, metal, plastic, glass, wood and ceramic, by jetting ink on the recording medium. In addition, in this specification, "image formation" refers not only to forming of the image, such as characters and graphics, having a meaning, but also to forming of the image, such as patterns, having no meaning (that is, simply jetting the ink). Furthermore, in this specification, the "ink" not only refers to the ink in the narrow sense, and also refers to any liquid, such as DNA samples, resists and pattern materials, that may be jetted onto the recording medium.

In the ink-jet type image forming apparatus, the image formation is made by jetting the ink, which includes a coloring material, in the form of ink drops (or droplets). For this reason, in conveniences such as the feathering in which the dots formed by the ink drops are distorted in a whisker shape, and the color bleeding in which the colors of the adjacent ink drops of different colors formed on the recording medium mix with each other to thereby make the color boundary unclear, may occur. Moreover, it takes time for the ink drops formed on the recording medium to dry after the image formation.

A Japanese Laid-Open Patent Application No. 8-323977 proposes a method of preventing the spreading by using a heater before or after the image formation, in order to promote drying of the ink after the image formation.

A Japanese Laid-Open Patent Application No. 2002-137378 proposes coating a pretreating liquid which reacts with the ink and promotes prevention of the spreading from a coat roller onto the recording medium. A Japanese Laid-Open Patent Application No. 2005-138502 proposes spraying a pretreating liquid in the form of mist from an ink-jet head onto the recording medium.

However, the power consumption of the image forming apparatus increases when the heater is used as proposed in the Japanese Laid-Open Patent Application No. 8-323977. On the other hand, when the pretreating liquid is coated by use of the coat roller or the ink-jet head as proposed in the Japanese Laid-Open Patent Applications No. 2002-137378 and No. 2005-138502, the pretreating liquid may not be coated uniformly on the recording medium. In addition, because the pretreating liquid is in liquid form, it may take time for the pretreating liquid to dry after reacting with the ink on the recording medium. Consequently, the recording medium may curl or shrink, to thereby increase the possibility of a paper jam occurring in the image forming apparatus. Furthermore, when the ink-jet head is used to coat the pretreating liquid as proposed in the Japanese Laid-Open Patent Application No. 2005-138502, the cost of the image forming apparatus increases because of the need to employ a combination of the pretreating liquid and the ink-jet head that would not easily cause a nozzle of the ink-jet head to clog, and such a combination is limited.

DISCLOSURE OF THE INVENTION

It is a general object of the present invention to provide a novel and useful an image forming apparatus and an apparatus for coating foam on a coating target member, in which the problems described above are suppressed.

A more specific object of the present invention is to provide an image forming apparatus and an apparatus for coating foam on a coating target member, which can uniformly coat a thin film of liquid or gel on a recording medium, and improve the drying property of the coated liquid or gel.

Still another object of the present invention is to provide an image forming apparatus comprising a generating mechanism configured to generate foam from a liquid or gel which may take a foam state; a coating roller, having a peripheral surface supplied with the foam, and configured to coat the foam on the peripheral surface onto a surface of a recording medium; and a transport passage configured to transport the foam from the generating mechanism to the coating roller by an accumulation force of the foam. According to the image forming apparatus of the present invention, it is possible to uniformly coat a thin film of liquid or gel on the recording medium, and improve the drying property of the coated liquid or gel.

A further object of the present invention is to provide an apparatus for coating foam on a coating target member, comprising a generating mechanism configured to generate foam from a liquid or gel which may take a foam state; a coating roller, having a peripheral surface supplied with the foam, and configured to coat the foam on the peripheral surface onto a surface of the coating target member; and a transport passage configured to transport the foam from the generating mechanism to the coating roller by an accumulation force of the foam. According to the apparatus of the present invention, it is possible to uniformly coat a thin film of liquid or gel on the coating target member, and improve the drying property of the coated liquid or gel.

Other objects and further features of the present invention will be apparent from the following detailed description when read in conjunction with the accompanying drawings.

BEST MODE FOR CARRYING OUT THE INVENTION

Figure 1:
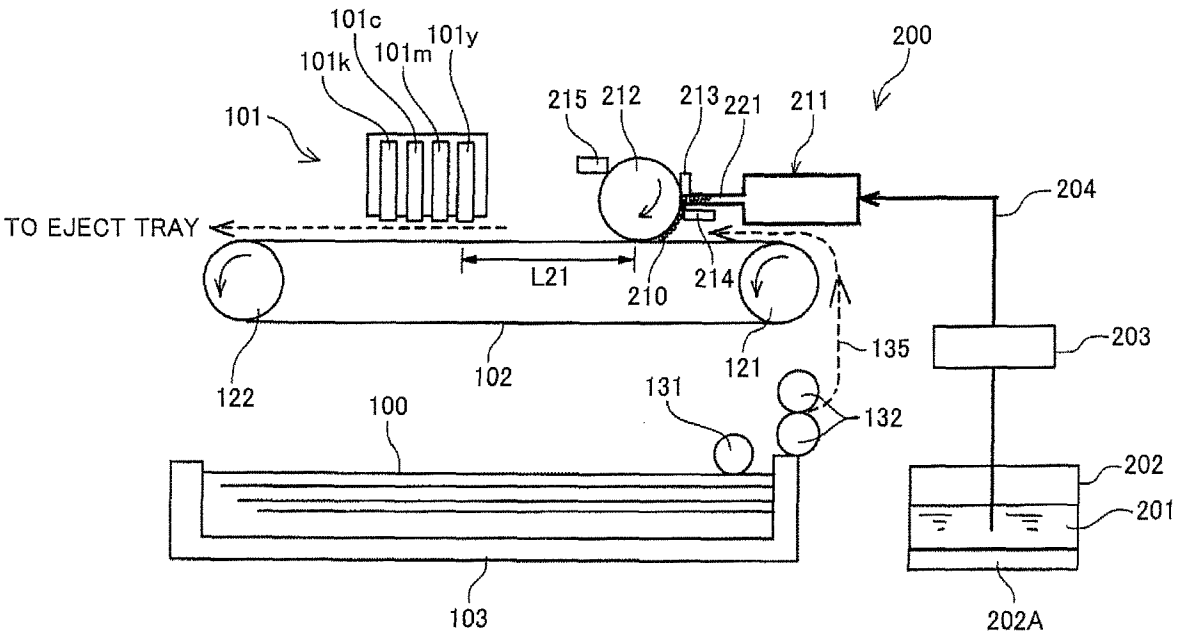
FIG. 1 is a diagram showing a general structure of an image forming apparatus in a first embodiment of the present invention.

In this specification, "foam" refers to liquid or gel in the form of foam or a foam state. The foam formed from a liquid is sometimes referred to as foam liquid, and the foam formed from a gel is sometimes referred to as foam gel. A large number of bubbles is distributed within the "foam", where each bubble includes therein a gas such as air and has a round shape. Each bubble is formed by the surface tension of the liquid or gel surrounding the gas. The "foam" maintains its three-dimensional shape for a predetermined time greater than zero. In order to maintain the three-dimensional shape, the "foam" preferably has a bubble content of 0.05 g/cm$^3$ or less in bulk density, a bubble diameter distributed in a range of 10 μm to 1 mm, and an average bubble diameter of 100 μm or less. The bubble by itself has a round shape, but when a plurality of bubbles connect or bond, the bubbles assume a polygonal shape due to the surface tension. In addition, the "gel" refers to a solidified semi-solid material in which high molecular compound or colloidal solution dispersed in a dispersion medium has lost independent mobility due to interaction, and grains connect to each other to form a net or honeycomb structure.

A description will now be given of embodiments of the image forming apparatus and the apparatus for coating foam on a coating target member according to the present invention, by referring to the drawings.

First, a description will be given of the image forming apparatus in a first embodiment of the present invention, by referring to FIG. 1. FIG. 1 is a diagram showing a general structure of the image forming apparatus in this first embodiment of the present invention.

The image forming apparatus shown in FIG. 1 includes a recording head unit 101 for jetting ink (or ink drops) to form an image on recording medium 100 such as paper, a transport belt 102 for transporting the recording medium 100, a supply tray 103 for accommodating the recording media 100, and a foam coating apparatus 200 which will be described later. The foam coating apparatus 200 coats foam on the recording medium 100, which is a coating target member, on an upstream side of the recording head unit 101 in a transport direction of the recording medium 100.

The recording head unit 101 is formed by a line type ink jet head having a plurality of nozzles for jetting the ink arranged in a line for a length amounting to the width of the recording medium 100. The recording head unit 101 includes recording heads 101*y*, 101*m*, 101*c* and 101*k* for respectively jetting ink drops of corresponding colors which are yellow (Y), magenta (M), cyan (C) and black (K). Of course, it is possible to mount the recording heads on a carriage to form a serial type image forming apparatus.

The transport belt 102 is formed by an endless belt which is configured to revolve in a state supported by a transport roller 121 and a tension roller 122. For example, the recording medium 100 may be adhered on the transport belt 102 by electrostatic suction or, air suction or, by a known transport means or mechanism.

The recording media 100 accommodated in the supply tray 103 are separated and fed one recording medium 100 at a time by a pickup roller 131, and supplied onto the transport belt 102 via a transport path 135 by a transport roller pair 132 and another transport roller pair (not shown). The recording medium 100 supplied onto the transport belt 102 is adhered on the transport belt 102.

The foam coating apparatus 200 coats the foam on the recording medium 100 which is transported by the transport belt 102. The foam which is coated on the recording medium 100 is dried, and the image is formed on the recording medium 100 by jetting the ink drops of each color from the recording head unit 101. The recording medium 100 after the image formation is ejected to an eject tray 104.

The foam coating apparatus 200 includes a container 202 containing a liquid 201 which may be formed into a foam state (foam liquid), a pump 203 for pumping the liquid 201 from the container 202, a foam generating apparatus 211, and a coating roller 212. The foam generating apparatus 211 is provided as a generating means for generating foam 210 having bubbles of a predetermined bubble diameter, from the liquid 201 which is supplied from the pump 203 via a supply passage 204. The coating roller 212 is supplied with the foam 210 from the foam generating apparatus 211, and has a peripheral surface which bears and holds the foam 210. The coating roller 212 coats the foam 210 held thereon onto the recording medium 100. The container 202 is provided with a heater (or heating means) 202A for maintaining the temperature of the liquid 201 to a predetermined temperature.

In addition, an opening and closing mechanism (or opening and closing means) 213 is provided to restrict the region on the coating roller 212 to which the foam 210 from the foam generating apparatus 211 is supplied. A thickness restricting member (or thickness restricting means) 214 is provided to restrict the film thickness (or coating thickness) of the foam 210 held on the peripheral surface of the coating roller 212. A cleaning member 215 is provided to remove the foam 210 remaining on the peripheral surface of the coating roller 212 after the foam 210 is coated on the recording medium 100.

The liquid 201 which may take the foam state is a reforming agent or a modifier which is coated on the surface of the recording medium 100 in order to reform or modify the surface of the recording medium 100. For example, the liquid 210 may be uniformly precoated on the recording medium 100, which is not limited to paper, in order to enable moisture of the ink to quickly penetrate the recording medium 100 and to increase the viscosity of the color components, and to further increase the drying speed to prevent the spreading (such as feathering and color bleeding) and strike through, and improve the productivity (that is, the number of recording media formed with images and output per unit time). Hence, the liquid 210 may be a fixing agent or a setting agent which is suited for such purposes.

The composition of the liquid 201 may be a solution in which a cellulose (for example, hydropropylcellulose) and a basis such as talc fine powder are added with respect to a surface active agent (anionic surface active agent, cationic surface active agent, nonionic surface active agent or a mixture of at least two of such surface active agents).

Preferably, the foam 210 has a bubble content in a range of approximately 0.01 g/cm$^3$ to approximately 0.1 g/cm$^3$ in bulk density.

By coating the foam 210 on the surface of the recording medium 100, it is possible to coat an extremely small amount of liquid because of the large amount of bubbles included in the foam 210. In addition, the foam 210 can be coated uniformly to a thin film, and the drying property of the coated thin film is improved. Accordingly, when the ink is jetted onto this thin film coated on the surface of the recording medium 100, it is possible to form a satisfactory image free of spreading, strike through, tone inconsistency and the like.

Figure 2:
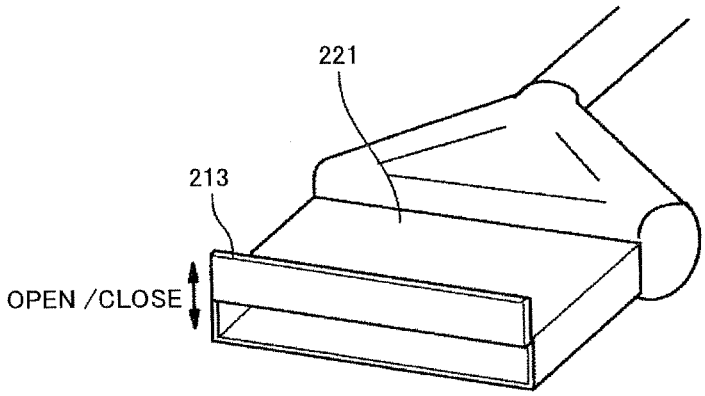
FIG. 2 is a perspective view showing an example of an opening and closing mechanism of a foam coating apparatus in the image forming apparatus.
Figure 3:
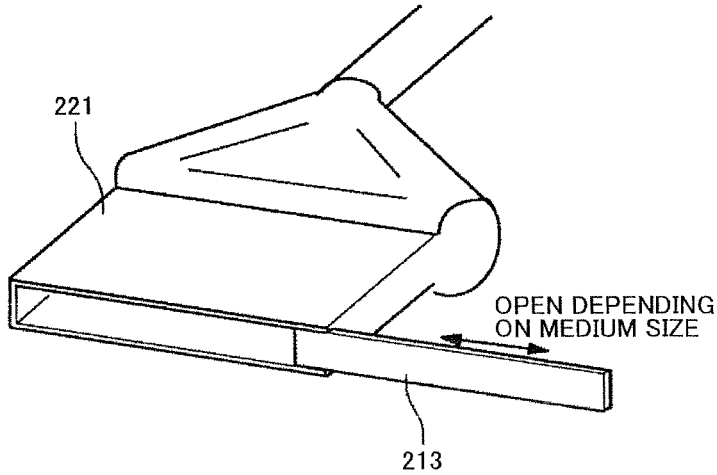
FIG. 3 is a perspective view showing another example of the opening and closing mechanism.

The opening and closing mechanism 213 may be configured to move up and down to open or close a supply opening 221 of the foam generating apparatus 211 as shown in FIG. 2 or, configured to move horizontally (that is, in a direction along the width of the recording medium 100) to open or close the supply opening 221 of the foam generating apparatus 211 as shown in FIG. 3. FIG. 2 is a perspective view showing an example of the opening and closing mechanism 213 of the foam coating apparatus 200 in the image forming apparatus, and FIG. 3 is a perspective view showing another example of the opening and closing mechanism 213.

According to the opening and closing mechanism 213 having the structure shown in FIG. 2, it is possible to adjust the coating region in the circumferential direction of the coating roller 212, and thus control the coating region in the transport direction with respect to the recording medium 100. On the other hand, according to the opening and closing mechanism 213 having the structure shown in FIG. 3, it is possible to adjust the coating region in the circumferential direction of the coating roller 212, and also adjust the coating region in the axial direction of the coating roller 212, and thus control the coating region in the width direction (that is, the direction perpendicular to the transport direction) with respect to the recording medium 100.

Figure 4:
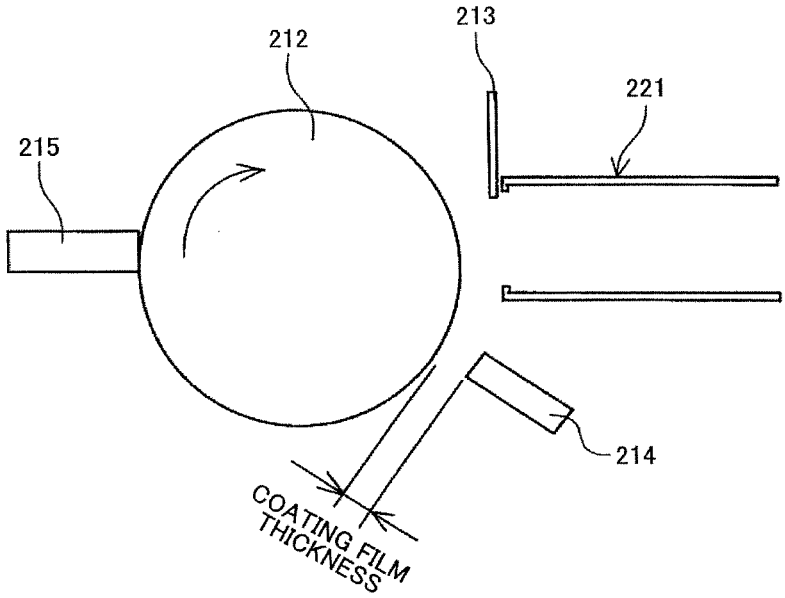
FIG. 4 is a diagram for explaining adjustment of a film thickness of the foam that is coated.

FIG. 4 is a diagram for explaining adjustment of a film thickness of the foam that is coated. As shown in FIG. 4, the thickness restricting member 214 can arbitrarily adjust the coating film thickness by controlling the distance between the peripheral surface of the coating roller 212 and the thickness restricting member 214. For example, by carrying out a predetermined operation from an operation and display part (not shown) of the image forming apparatus, the thickness restricting member 214 is moved in the tangential direction or a normal direction with respect to the peripheral surface of the coating roller 212 by a driving mechanism or driving means (not shown), in order to adjust the distance between the coating roller 212 and the thickness restricting member 214. Hence, the coating film thickness of the foam can be set to an arbitrary value by such an operation.

Figure 5:
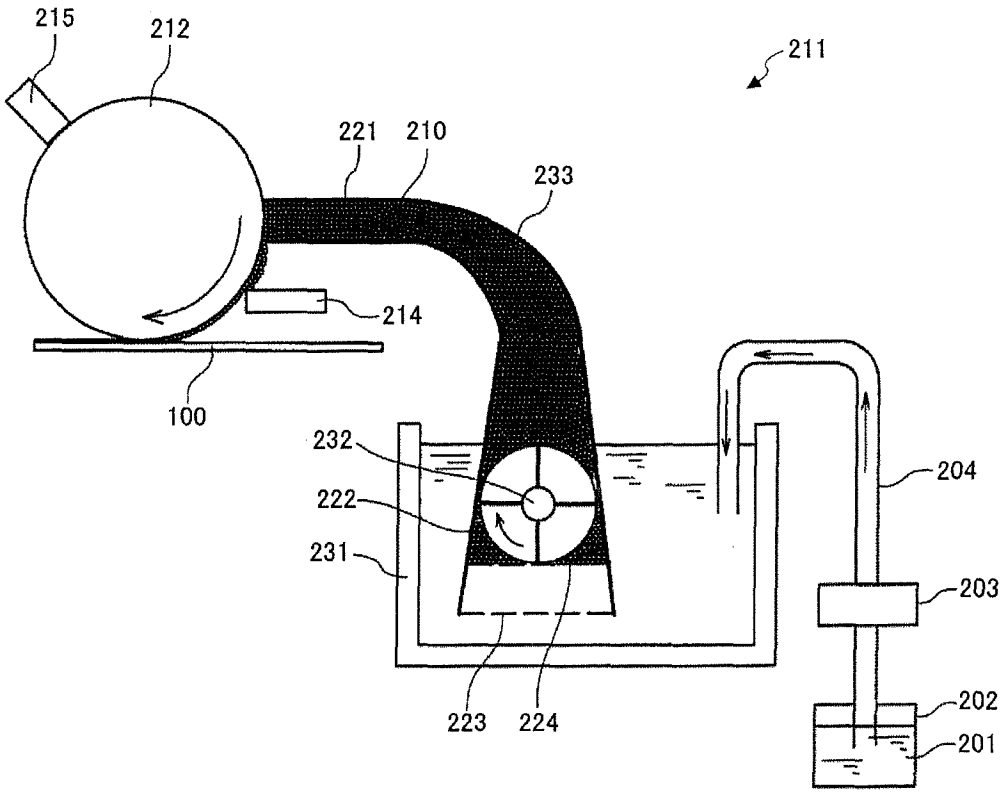
FIG. 5 is a diagram for explaining an example of the foam coating apparatus in the image forming apparatus.

Next, a description will be given of an example of the foam generating apparatus 211 of the foam coating apparatus 200, by referring to FIG. 5. FIG. 5 is a diagram for explaining an example of the foam coating apparatus 200 in the image forming apparatus.

The foam generating apparatus 211 shown in FIG. 5 includes a container 231 containing the liquid 201 supplied from the container 202 by the pump 203, an agitating mechanism (or agitating means) 232 for agitating the liquid 201 within the container 231, and a foam transport passage 233 which transports and supplies the foam 210 which is generated by the agitating mechanism 232 towards the coating roller 212 by an accumulation force of the foam 210. The agitating mechanism 232 forms a foam generating mechanism (or foam generating means) for generating the foam 210.

The foam transport passage 233 has the supply opening 221 on the end closer to the coating roller 212. On the other hand, the foam transport passage 233 has a first slit 223 and a second slit 224 on the end of a foam inlet 222 surrounding the periphery of the agitating mechanism 232.

Figure 6:
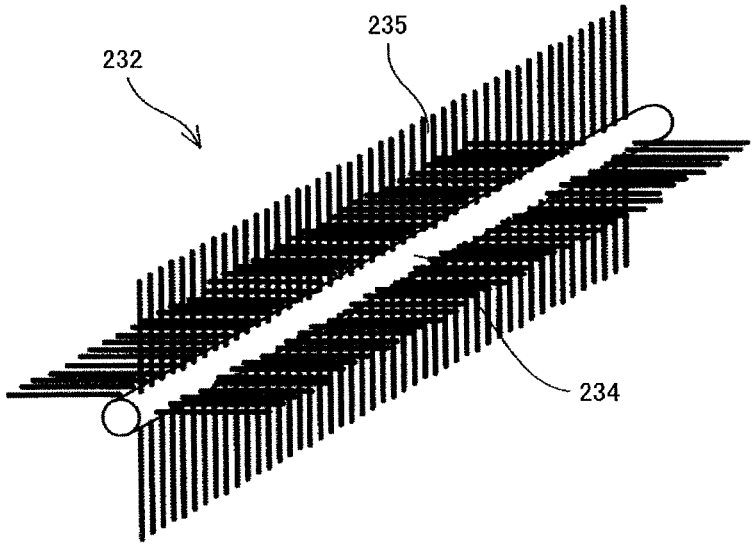
FIG. 6 is a perspective view showing an example of an agitating mechanism of the foam coating apparatus.

For example, the agitating mechanism 232 may have a structure shown in FIG. 6. FIG. 6 is a perspective view showing an example of the agitating mechanism 232 of the foam coating apparatus 200. As shown in FIG. 6, the agitating mechanism 232 has brushes 235 embedded in the periphery of a rod 234. Of course, the agitating mechanism 232 may have a screw-like structure.

In the foam generating apparatus 211 having the structure described above, the foam 210 is generated from the liquid 201 by rotating the agitating mechanism 232. While the agitating mechanism 232 is rotating (or agitating), the foam 210 is supplied into the transport passage 233 and the foam 210 is accumulated within the transport passage 233. Hence, due to the accumulation force of the foam 210 within the transport passage 233, the foam 210 is gradually transported towards the supply opening 221, and the foam 210 is thereafter supplied onto the coating roller 212 from the supply opening 221 as described above. The accumulation force is a force which acts in a direction to increase the volume of the foam 210, and the direction in which the accumulation force acts is not limited to the vertical direction. In addition, when the agitating operation of the agitating mechanism 232 stops, the accumulation of the foam 210 within the transport passage 233 stops, to thereby stop the supply of the foam 210 from the supply opening 221.

Therefore, the foam 210 is transported and supplied to the coating roller 212 by the accumulation force of the foam 210, without having to use a special transport mechanism. As a result, it is possible to simplify the structure of the foam coating apparatus 200 and the image forming apparatus.

Figure 7:
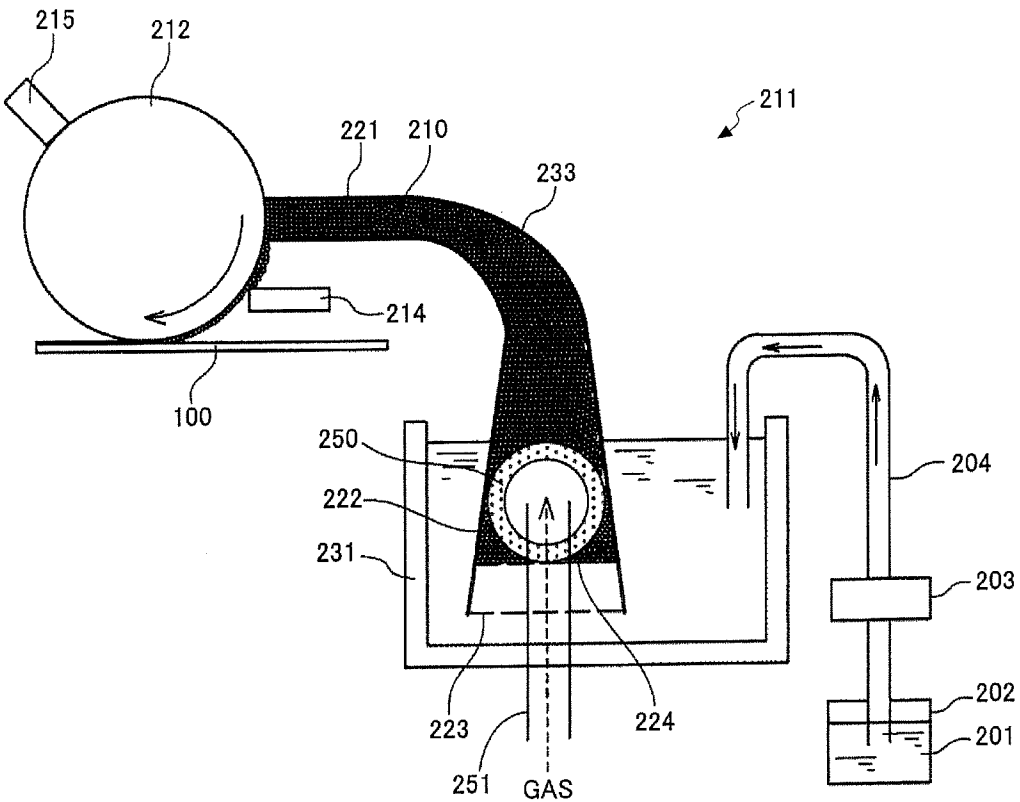
FIG. 7 is a diagram for explaining another example of the foam coating apparatus.

Next, a description will be given of another example of the foam generating apparatus 211 of the foam coating apparatus 200, by referring to FIG. 7. FIG. 7 is a diagram for explaining another example of the foam coating apparatus 200. In FIG. 7, those parts that are the same as those corresponding parts in FIG. 5 are designated by the same reference numerals, and a description thereof will be omitted.

As shown in FIG. 7, the foam generating apparatus 211 includes, as the foam generating mechanism (or foam generating means) for generating the foam 210, a cylindrical porous member 250 and a gas supply mechanism (or gas supply means) 251 for supplying gas into the porous member 250. For example, the gas supply mechanism 251 includes a fan and a duct for supplying air into the porous member 250.

According to the foam generating apparatus 211 having the structure shown in FIG. 7, the foam 210 is generated by supplying the gas into the porous member 250. While the gas is being supplied to generate the foam 210, the foam 210 moves within the transport passage 233 and is supplied to the coating roller 212. When the supply of the gas to the porous member 250 stops, the accumulation of the foam 210 within the transport passage 233 stops, to thereby stop the transport of the foam 210.

In addition, according to the foam generating apparatus 211 having the structure shown in FIG. 7, it is also possible to transport the foam 210 by the pressure of a gas supplied from the gas supply mechanism 251. In other words, it is possible to use a transport force other than the accumulation force of the foam 210 in order to transport the form 210, in addition to the accumulation force of the foam 210, as will be described later.

Figure 8:
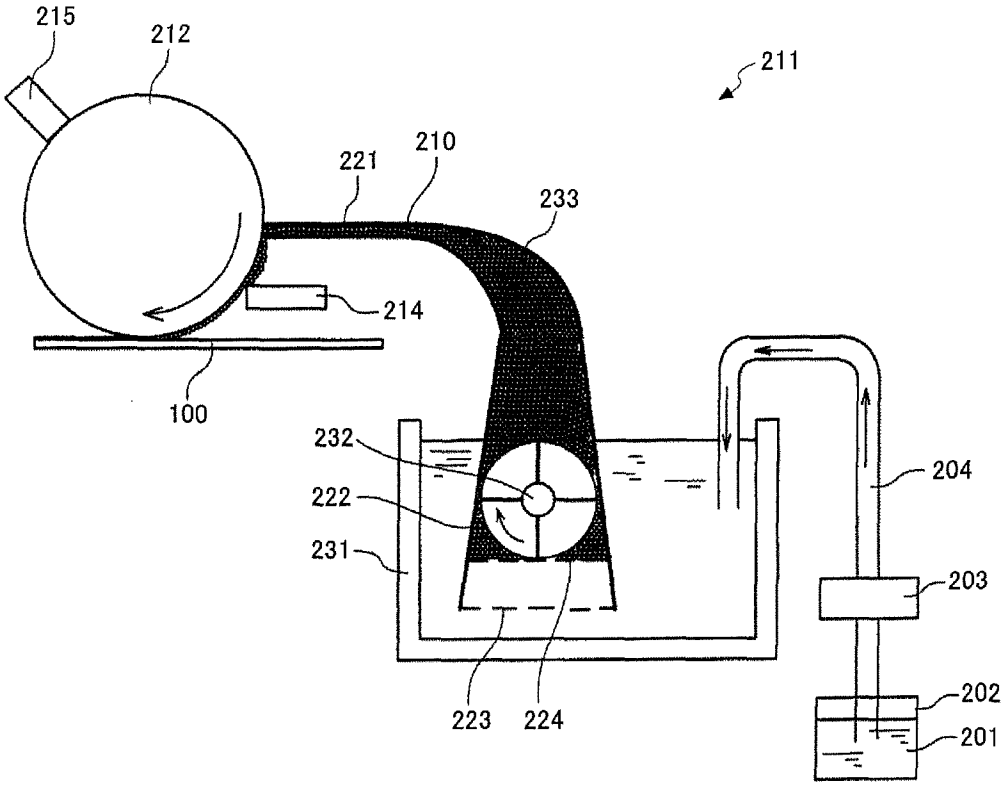
FIG. 8 is a diagram showing still another example of the foam coating apparatus.

Next, a description will be given of still another example of the foam generating apparatus 211 of the foam coating apparatus 200, by referring to FIG. 8. FIG. 8 is a diagram showing still another example of the foam coating apparatus 200. In FIG. 8, those parts that are the same as those corresponding parts in FIG. 5 are designated by the same reference numerals, and a description thereof will be omitted.

As shown in FIG. 8, in the foam generating apparatus 211, the width (cross section of the opening) of a supply passage part 233A on the end of the transport passage 233 closer to the coating roller 212 is made narrower (smaller) than those of the foam generating apparatuses 211 shown in FIGS. 5 and 7. Hence, when compared to the foam generating apparatuses 211 shown in FIGS. 5 and 7, the foam generating apparatus 211 shown in FIG. 8 can coat the peripheral surface of the coating roller 212 more uniformly for the amount corresponding to the width of the recording medium 100.

Figure 9:
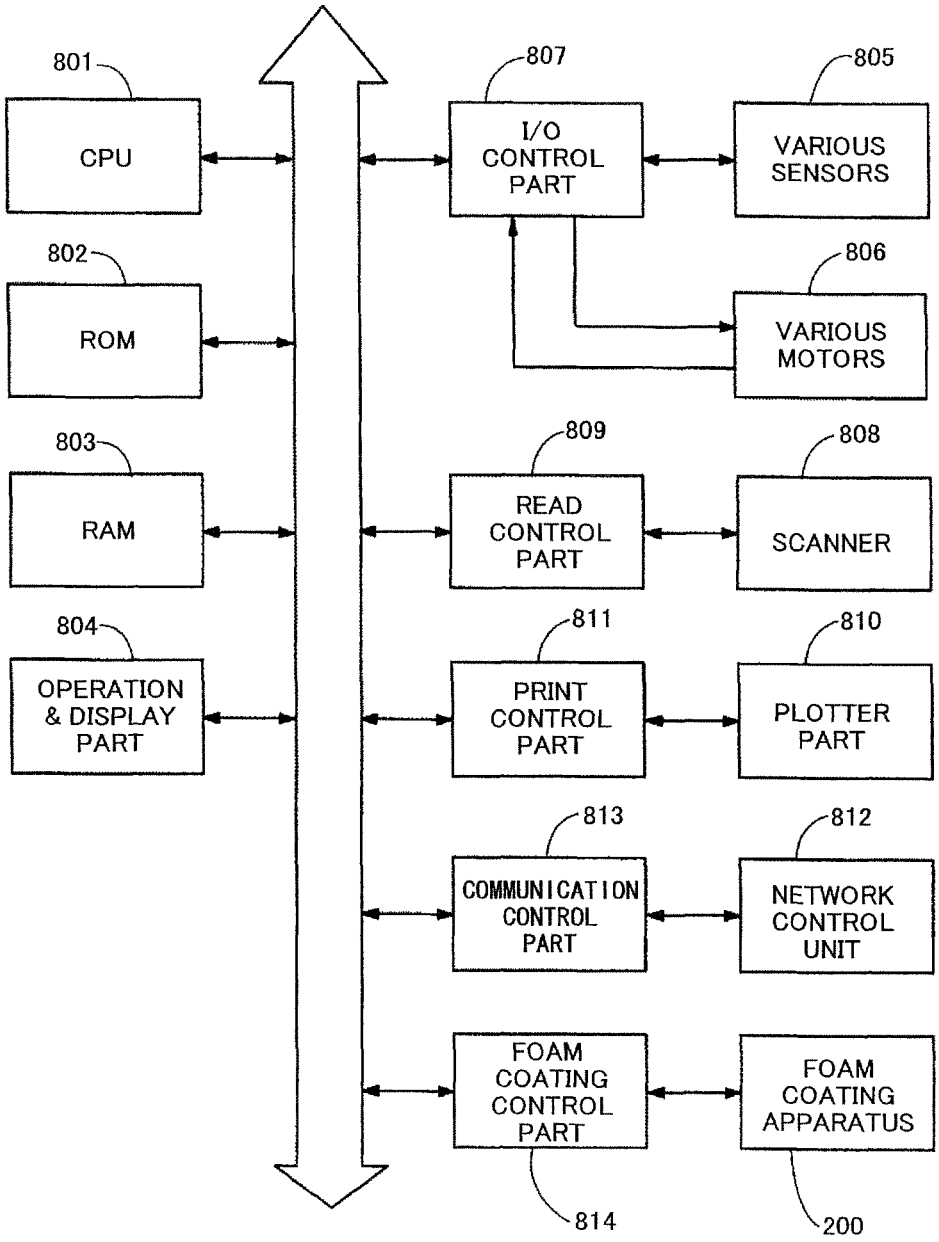
FIG. 9 is a block diagram generally showing a control part of the image forming apparatus.

Next, a description will be given of a control part of the image forming apparatus, by referring to FIG. 9. FIG. 9 is a block diagram generally showing the control part of the image forming apparatus.

The control part shown in FIG. 9 includes a CPU 801 for carrying out a system control of the image forming apparatus, a ROM 802 for storing information and programs executed by the CPU 801, a RAM 803 for use as a working area, an operation and display part 804 which is operated by a user (or operator) to make various settings and the like, various sensors 805 for detecting the recording medium size, the jam and the like, various motors 806, an input and output (I/O) control part 807 for controlling inputs to the various motors 806 and the outputs from the various sensors 805, a read control part 809 for controlling an image reading apparatus (or scanner) 808, a print control part 811 for controlling a plotter part (or print mechanism part) 810, a communication control part 813 for carrying out various facsimile communication controls, including control of a network control unit 812 which controls an interface (I/F) with a telephone line (not shown), and a foam coating control part 814 for controlling the foam coating apparatus 200.

The various sensors 805 include temperature and/or humidity sensor for detecting an environmental condition, and a liquid end sensor for detecting whether or not the liquid 200 which make be formed into the foam 210 exists within the container 201. The various sensors 805 may include a sensor for detecting a tip end of the recording medium 100 on the transport belt 102, a sensor for detecting whether or not a predetermined amount of liquid 201 remains within the container 202, and a sensor for detecting whether or not a predetermined amount of liquid 201 remains within the container 231.

Figure 10:
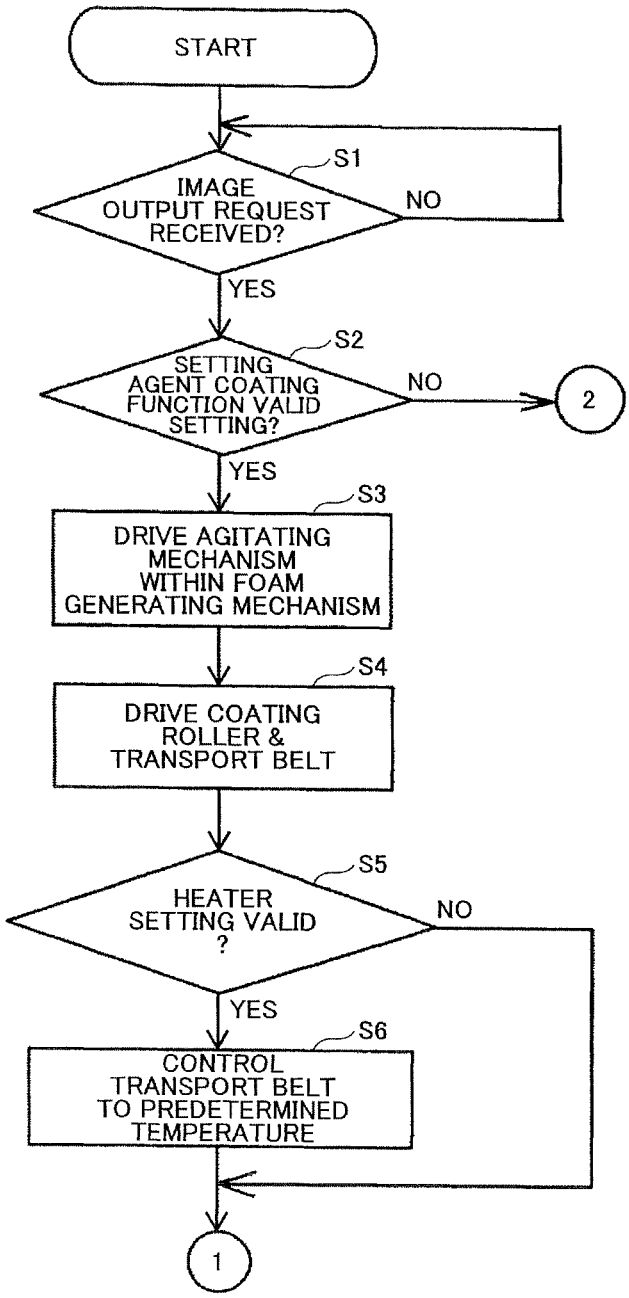
FIG. 10 is a flow chart for explaining an example of a print process of the control part.
Figure 11:
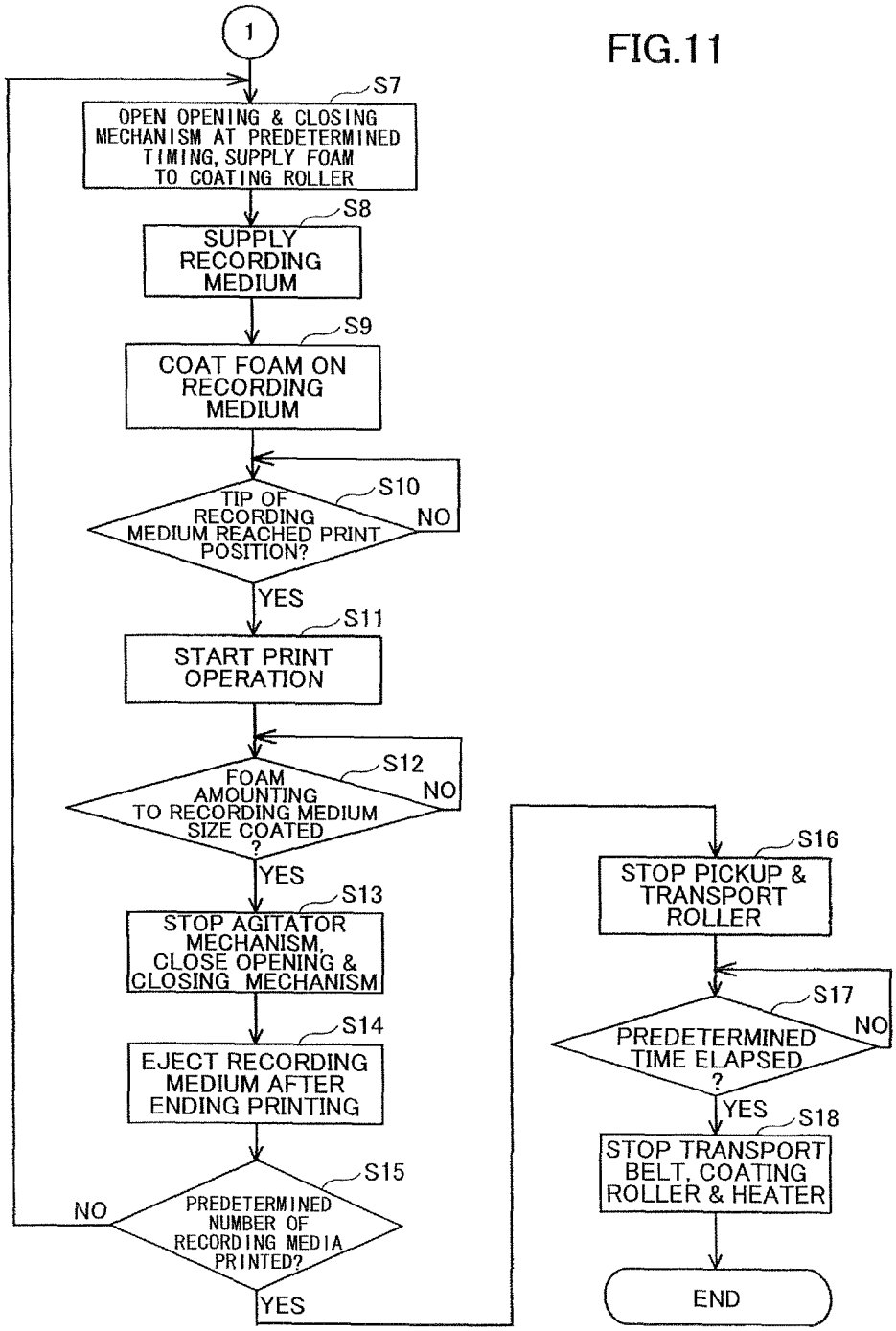
FIG. 11 is a flow chart for explaining the print process of the control part continued from FIG. 10.
Figure 12:
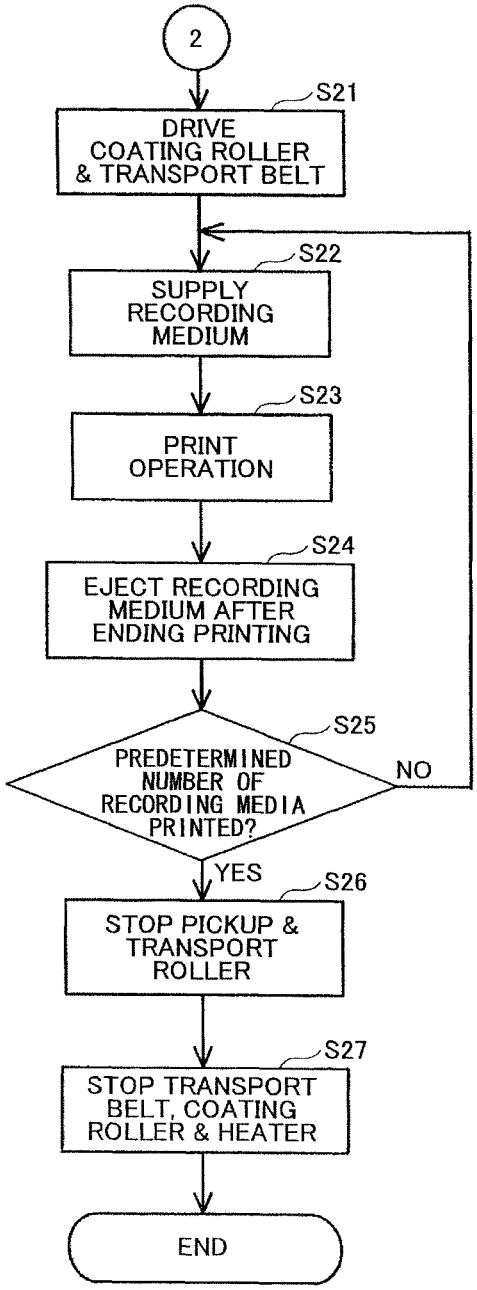
FIG. 12 is a flow chart for explaining the print process of the control part continued from FIG. 10.

Next, a description will be given of a first example of a print process of the image forming apparatus, by referring to FIGS. 10 through 12. FIGS. 10 through 12 are flow charts for explaining this first example of the print process of the control part. It is assumed for the sake of convenience that the foam generating mechanism (or foam generating means) for generating the foam 210 in the foam generating apparatus 211 is formed by the agitating mechanism 232.

In FIG. 10, when an image output request is received (YES in step S1), a decision is made to determine if the setting agent coating function (function of coating the foam) has been set to a valid setting (step S2). If the setting agent coating function has been set to the valid setting (YES in step S2), the agitating mechanism 232 within the foam generating apparatus 211 is driven and rotated to start generating the foam 210 (step S3). In addition, the coating roller 212 and the transport belt 102 are driven, and the opening and closing mechanism 213 is opened at a predetermined timing, in order to supply the foam 210 to the coating roller 212 (step S4). A decision is made to determine if a heater (not shown) which is provided in the transport roller 121 or the tension roller 122 and heats the recording medium 100 has been set to a valid setting (step S5). If the heater has been set to the valid setting (YES in step S5), the heater is controlled in order to control the transport belt 102 to a predetermined temperature (step S6). The heater is controlled based on a detection result of the temperature and/or humidity sensor which detects the temperature and/or humidity of the transport belt 102.

Next, in FIG. 11, the opening and closing mechanism 213 is opened at a predetermined timing, and the foam 210 is supplied from the foam generating apparatus 211 to the coating roller 212 (step S7). The recording medium 100 is supplied from the supply part (or supply cassette) 103 by the pickup roller 131 onto the transport belt 102 (step S8). The coating roller 212 coats the foam 210 on the surface of the recording medium (step S9), and the print operation by the recording head unit 101 is started (step S11) if the tip end of the recording medium has reached a print position of the recording head unit 101, based on a detection result of a medium sensor, for example (YES in step S10). If the coating of the foam 210 amounting to the size of the recording medium 100 ends (YES in step S12), the driving of the agitating mechanism 232 within the foam generating apparatus 211 is stopped and the opening and closing mechanism 213 is closed (step S13).

The recording medium 100 on which the printing has ended is ejected to the eject tray 104 (step S14), and the process starting from the supply of the recording medium 100 is repeated until a requested number of recording media 100 has been printed (YES in step S15). If the requested number of recording media 100 has been printed, the operation of the pickup roller 131 and the transport roller 132 is stopped (step S16), and the operation of the transport belt 102, the coating roller 212 and the heater is stopped (step S18) after a predetermined time elapses (YES in step S17).

On the other hand, if the setting agent coating function has not be set to the valid setting (NO in step S2) in FIG. 10, the process advances to the process shown in FIG. 12. In FIG. 12, the coating roller 212 and the transport belt 102 are driven (step S21), and the recording medium 100 is supplied from the supply part 103 by the pickup roller 131 onto the transport belt 102 (step S22). The print operation of the recording head unit 101 is made with respect to the recording medium 100 (step S23), and the recording medium 100 on which the printing has ended is ejected to the eject tray 104 (step S24). If the requested number of recording media 100 has been printed (YES in step S25), the operation of the pickup roller 131 and the transport roller 132 is stopped (step S26), and after a predetermined time elapses, the operation of the transport belt 102 and the coating roller 212 is stopped (step S27).

The coating roller 212 is also driven and rotated in order not to interfere with the transport of the recording medium 100 on the transport belt 102, because a gap between the peripheral surface of the coating roller 212 and the transport belt 102 is, at the maximum, less than or equal to a sum of the thickness of the recording medium 100 and the film thickness of the foam 210.

Figure 13:
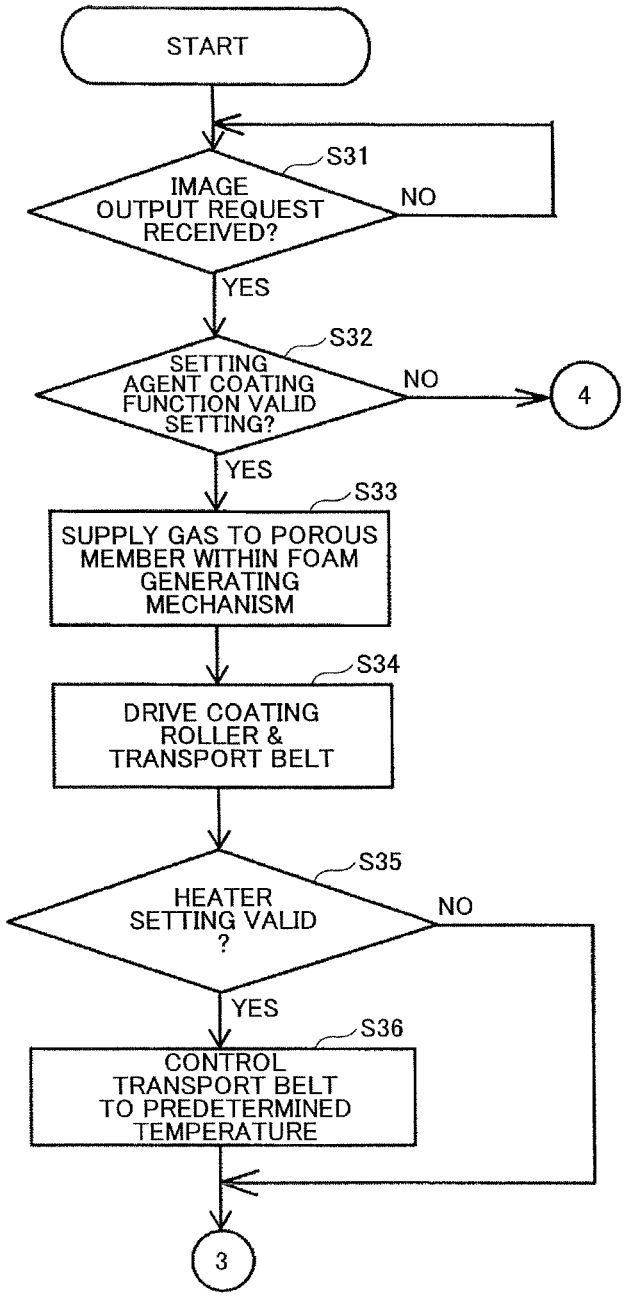
FIG. 13 is a flow chart for explaining another example of the print process of the control part.
Figure 14:
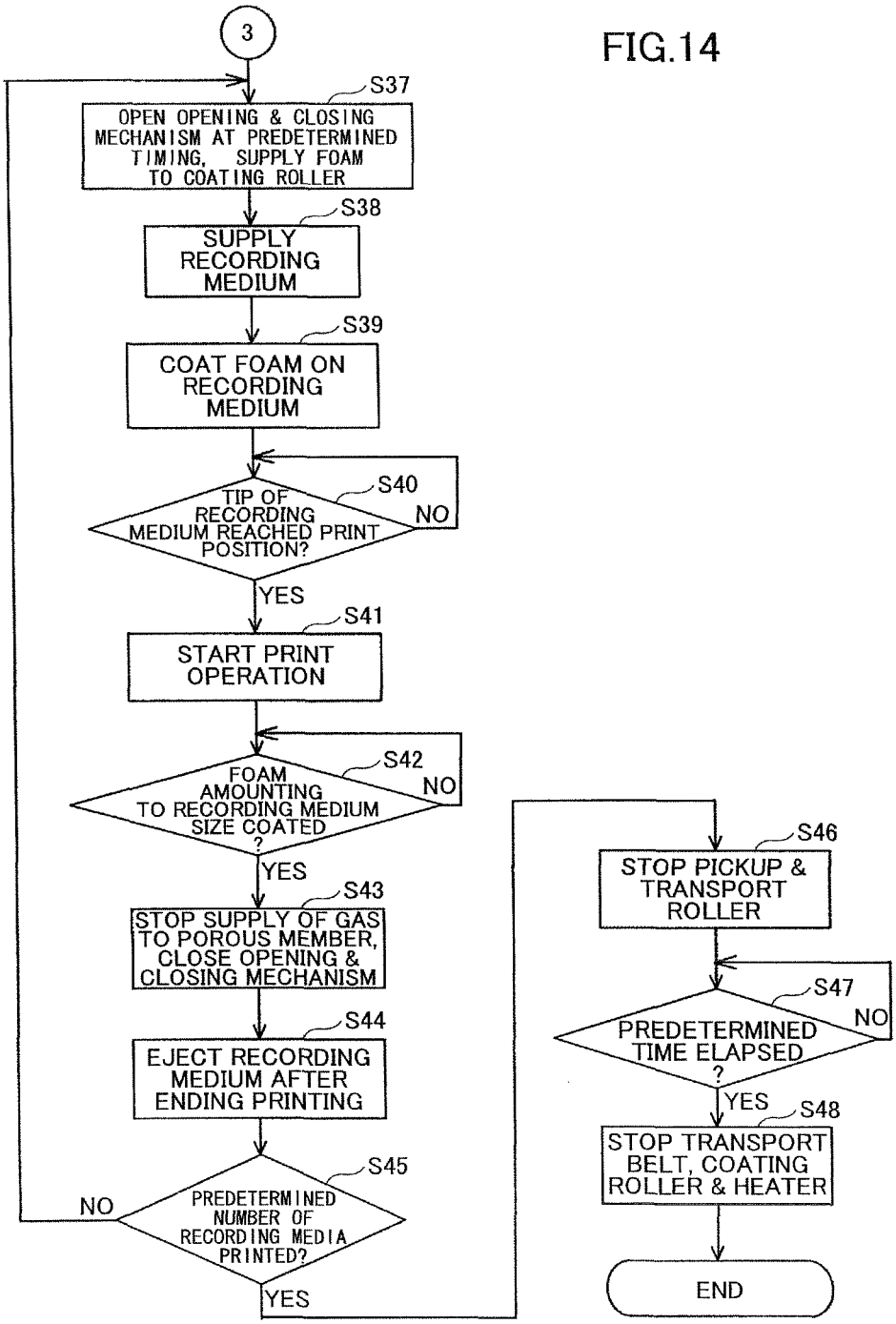
FIG. 14 is a flow chart for explaining the print process of the control part continued from FIG. 13.
Figure 15:
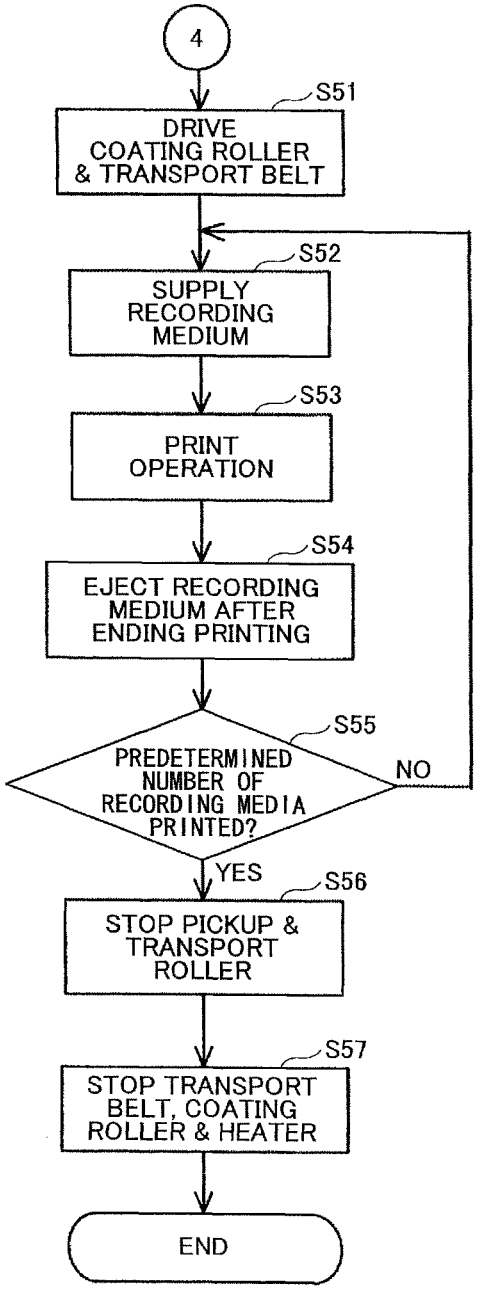
FIG. 15 is a flow chart for explaining the print process of the control part continued from FIG. 13.

Next, a description will be given of a second example of the print process of the image forming apparatus, by referring to FIGS. 13 through 15. FIGS. 13 through 15 are flow charts for explaining this second example of the print process of the control part. It is assumed for the sake of convenience that the foam generating mechanism (or foam generating means) for generating the foam 210 in the foam generating apparatus 211 is formed by the porous member 250 and the gas supply mechanism 251.

In FIG. 13, when an image output request is received (YES in step S31), a decision is made to determine if the setting agent coating function (function of coating the foam) has been set to a valid setting (step S32). If the setting agent coating function has been set to the valid setting (YES in step S32), the gas supply mechanism 251 within the foam generating apparatus 211 supplies the gas to the porous member 250 to start generating the foam 210 (step S33). In addition, the coating roller 212 and the transport belt 102 are driven, and the opening and closing mechanism 213 is opened at a predetermined timing, in order to supply the foam 210 to the coating roller 212 (step S34). A decision is made to determine if a heater (not shown) which is provided in the transport roller 121 or the tension roller 122 and heats the recording medium 100 has been set to a valid setting (step S35). If the heater has been set to the valid setting (YES in step S35), the heater is controlled in order to control the transport belt 102 to a predetermined temperature (step S36). The heater is controlled based on a detection result of the temperature and/or humidity sensor which detects the temperature and/or humidity of the transport belt 102.

Next, in FIG. 14, the opening and closing mechanism 213 is opened at a predetermined timing, and the foam 210 is supplied from the foam generating apparatus 211 to the coating roller 212 (step S37). The recording medium 100 is supplied from the supply part (or supply cassette) 103 by the pickup roller 131 onto the transport belt 102 (step S38). The coating roller 212 coats the foam 210 on the surface of the recording medium (step S39), and the print operation by the recording head unit 101 is started (step S41) if the tip end of the recording medium has reached a print position of the recording head unit 101, based on a detection result of a medium sensor, for example (YES in step S40). If the coating of the foam 210 amounting to the size of the recording medium 100 ends (YES in step S42), the supply of the gas from the gas supply mechanism 251 to the porous member 250 within the foam generating apparatus 211 is stopped and the opening and closing mechanism 213 is closed (step S43).

The recording medium 100 on which the printing has ended is ejected to the eject tray 104 (step S44), and the process starting from the supply of the recording medium 100 is repeated until a requested number of recording media 100 has been printed (YES in step S45). If the requested number of recording media 100 has been printed, the operation of the pickup roller 131 and the transport roller 132 is stopped (step S46), and the operation of the transport belt 102, the coating roller 212 and the heater is stopped (step S48) after a predetermined time elapses (YES in step S47).

On the other hand, if the setting agent coating function has not be set to the valid setting (NO in step S22) in FIG. 13, the process advances to the process shown in FIG. 15. In FIG. 15, the coating roller 212 and the transport belt 102 are driven (step S51), and the recording medium 100 is supplied from the supply part 103 by the pickup roller 131 onto the transport belt 102 (step S52). The print operation of the recording head unit 101 is made with respect to the recording medium 100 (step S53), and the recording medium 100 on which the printing has ended is ejected to the eject tray 104 (step S54). If the requested number of recording media 100 has been printed (YES in step S55), the operation of the pickup roller 131 and the transport roller 132 is stopped (step S56), and after a predetermined time elapses, the operation of the transport belt 102 and the coating roller 212 is stopped (step S57).

The coating roller 212 is also driven and rotated in order not to interfere with the transport of the recording medium 100 on the transport belt 102, because the gap between the peripheral surface of the coating roller 212 and the transport belt 102 is, at the maximum, less than or equal to a sum of the thickness of the recording medium 100 and the film thickness of the foam 210.

Figure 16:
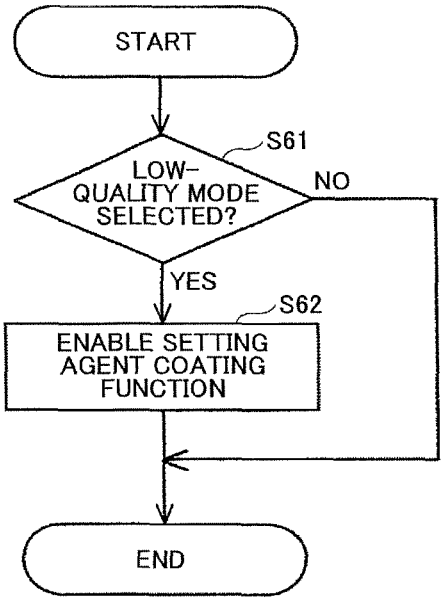
FIG. 16 is a flow chart for explaining an example of a setting agent coating function setting process of the control part.

Next, a description will be given of an example of a setting process to set the setting agent coating function (hereafter referred to as a setting agent coating function setting process), by referring to FIG. 16. FIG. 16 is a flow chart for explaining this example of the setting agent coating function setting process of the control part.

In this example, the operating cost is reduced by not using the setting agent if it is sufficient to form on the recording medium 100 an image having a relatively low picture quality. A low-quality mode which permits the image formed on the recording medium 100 may have a relatively low picture quality is selected from the operation and display part 804 or, from a host computer (for example, a personal computer) by carrying out a predetermined operation by a printer driver of the host computer. If the low-quality mode is selected (YES in step S61), the setting agent coating function is set to an invalid setting (step S62) to disable the setting agent coating function.

Figure 17:
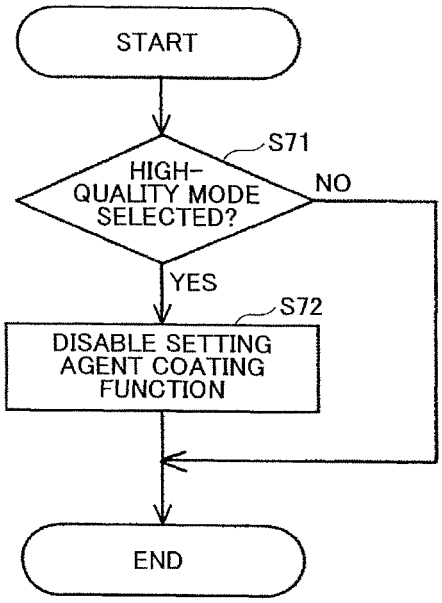
FIG. 17 is a flow chart for explaining another example of the setting agent coating function setting process of the control part.

Next, a description will be given of another example of the setting agent coating function setting process, by referring to FIG. 17. FIG. 17 is a flow chart for explaining this other example of the setting agent coating function setting process of the control part.

In this example, the heater for heating the recording medium 100 on the transport belt 102 is provided in at least one of the transport roller 121 and the tension roller 122. The heater is used to speed up the drying of the setting agent and the ink on the recording medium 100 when an image having a relatively high picture quality is to be formed on the recording medium. A high-quality mode which requires the image formed on the recording medium 100 to have a relatively high picture quality is selected from the operation and display part 804 or, from the host computer by carrying out a predetermined operation by the printer driver of the host computer. If the high-quality mode is selected (YES in step S71), the setting agent coating function is set to a valid setting (step S72) to enable the setting agent coating function.

Figure 18:
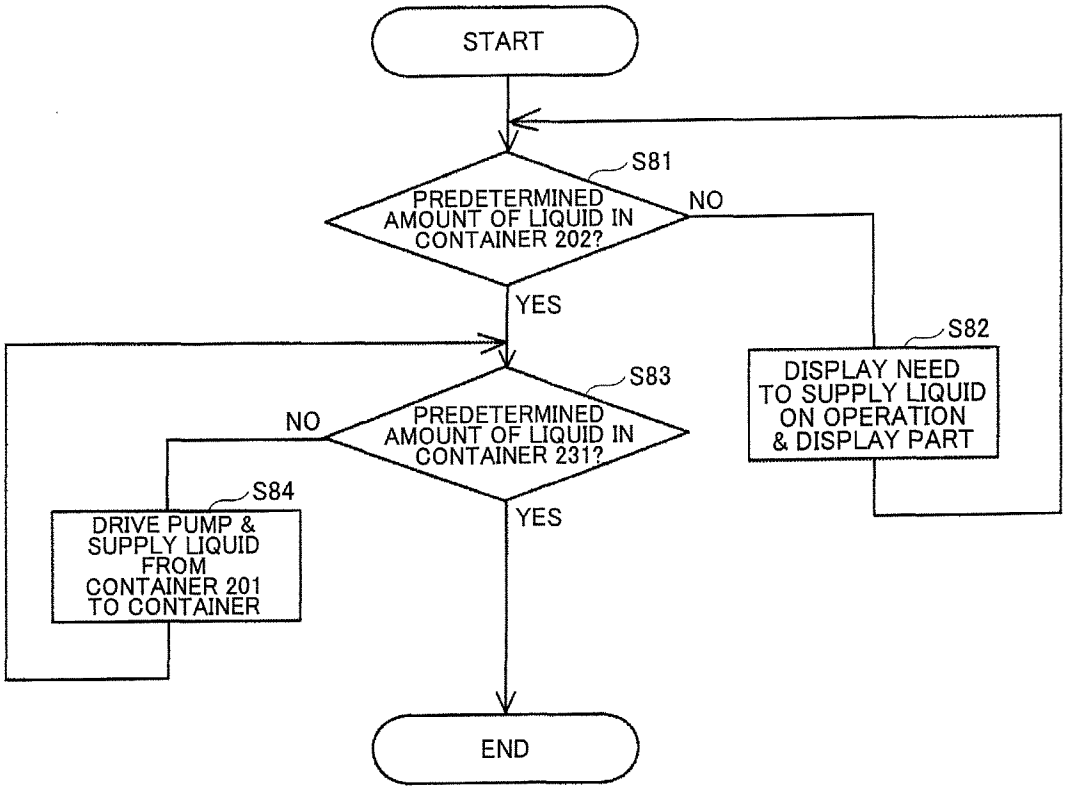
FIG. 18 is a flow chart for explaining a liquid end detection process and a liquid supplying process of the control part.

Next, a description will be given of a liquid end detection process and a liquid supplying process, with respect to the liquid 201 which is formed into the foam 210 and is contained in the containers 202 and 231, by referring to FIG. 18. FIG. 18 is a flow chart for explaining the liquid end detection process and the liquid supplying process of the control part.

One sensor (not shown), among the various sensors 805, detects whether or not a predetermined amount of liquid 201 remains within the container 202 (step S81). If the liquid 201 remaining within the container 202 is less than the predetermined amount (NO in step S81), a display is made on the operation and display part 804 to indicate that the remaining amount of liquid 201 is insufficient and the liquid 201 needs to be supplied (step S82). This display on the operation and display part 804 is stopped if the liquid 201 is supplied and the remaining amount of liquid 201 within the container 202 is the predetermined amount or more (YES in step S81).

Another sensor (not shown), among the various sensors 805, detects whether or not a predetermined amount of liquid 201 remains within the container 231 (step S83). If the liquid 201 remaining within the container 231 is less than the predetermined amount (NO in step S83), the pump 203 is driven to supply the liquid 201 from the container 202 to the container 231. The driving of the pump 203 is stopped to stop the supply of the liquid 201 to the container 231 if the remaining amount of liquid 201 within the container 231 is the predetermined amount or more (YES in step S83).

Figure 19:
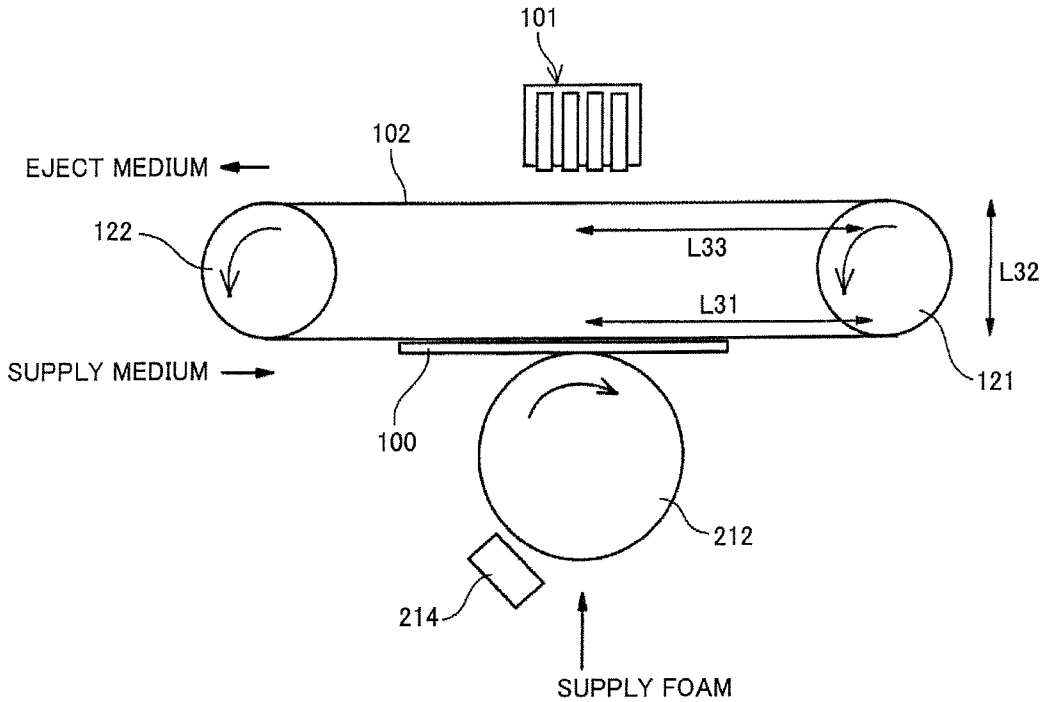
FIG. 19 is a diagram showing an important part of the image forming apparatus in a second embodiment of the present invention.

Next, a description will be given of an image forming apparatus in a second embodiment of the present invention, by referring to FIG. 19. FIG. 19 is a diagram showing an important part of the image forming apparatus in this second embodiment of the present invention. In FIG. 19, those parts that are the same as those corresponding parts in FIG. 1 are designated by the same reference numerals, and a description thereof will be omitted.

In the image forming apparatus shown in FIG. 19, the coating roller 212 is arranged below the transport belt 102. The recording medium 100 is supplied from under the tension roller 122, and is transported in a state where the recording medium 100 is adhered on the lower portion of the transport belt 102. The coating roller 212 coats the foam 210 on the recording medium 100 on the transport belt 102, and the transport direction is changed by 180 degrees by the transport roller 121 on the upper portion of the transport belt 102. The recording head unit 101 then forms an image on the recording medium 100, and the recording medium 100 is thereafter ejected to the eject tray 104 (not shown).

In other words, the coating roller 212, and the transport path formed by the transport belt 102 which transports the recording medium 100 to the coating position of the coating roller 212 are arranged with a positional relationship such that the coating position is located above the coating roller 212 in the vertical direction. On the other hand, in FIG. 1, the coating position is located below the coating roller 212 in the vertical direction.

Because the foam (setting agent) 210, which is supplied to the peripheral surface of the coating roller 212, has a strong adherence due to the foam property thereof, the foam 210 is positively held on the peripheral surface of the coating roller 212 even when supplied from underneath the coating roller 212 against the gravitational force, and not supplied from the side of the coating roller 212 as in the first embodiment. Hence, the foam 210 is stably supplied to the coating position with respect to the recording medium 100.

In this second embodiment, a distance from the coating position of the foam 210 by the coating roller 212 to the print position of the recording head unit 101 is [L31+L32+L33] in FIG. 19. For this reason, compared to the first embodiment shown in FIG. 1, this second embodiment can reduce the horizontal span of the transport belt 102 in the belt circulating direction and minimize the length of the transport belt 102, to thereby enable the size of the image forming apparatus to be reduced. The distance [L31+L32+L33] is set to a distance such that the moisture in the ink penetration depth range at the surface of the recording medium 100 can be reduced to a level which will not cause picture quality deterioration (spreading), and if necessary, taking into consideration the drying speed of the foam 210.

In the first embodiment shown in FIG. 1, the distance from the coating position of the foam 210 by the coating roller 212 to the print position of the recording head unit 101 is L21. But if the distance L21 is simply increased because the foam 210 needs to be dry at the print position, the length of the transport belt 102 becomes long and the size of the image forming apparatus increases, making it difficult to reduce the size of the image forming apparatus.

On the other hand, because this second embodiment shown in FIG. 19 has the coating position of the coating roller 212 located above the coating roller 212 in the vertical direction, it is possible to reduce the length of the transport belt 102 compared to the first embodiment if the distance from the coating position of the foam 210 by the coating roller 212 to the print position of the recording head unit 101 in this second embodiment were set identical to the distance from the coating position of the foam 210 by the coating roller 212 to the print position of the recording head unit 101 in the first embodiment.

Therefore, the size of the image forming apparatus can be reduced by setting the positional relationship between the coating roller 212 and the transport path which transports the recording medium 100 to the coating position of the coating roller 212 so that the coating position is located at a position other than below the coating roller 212 in the vertical direction. In this second embodiment, the positional relationship between the coating roller 212 and the transport path which transports the recording medium 100 to the coating position of the coating roller 212 is set so that the coating position is located above the coating roller 212 in the vertical direction.

The foam generating mechanism (or foam generating means) for generating the foam 210 in this second embodiment is not limited to that of the first embodiment which supplies the foam 210 by the accumulation force thereof. For example, a screw-like structure may be used to generate the foam (foam setting agent) 210 having bubbles of a predetermined bubble diameter by agitating the liquid 201.

Figure 20:
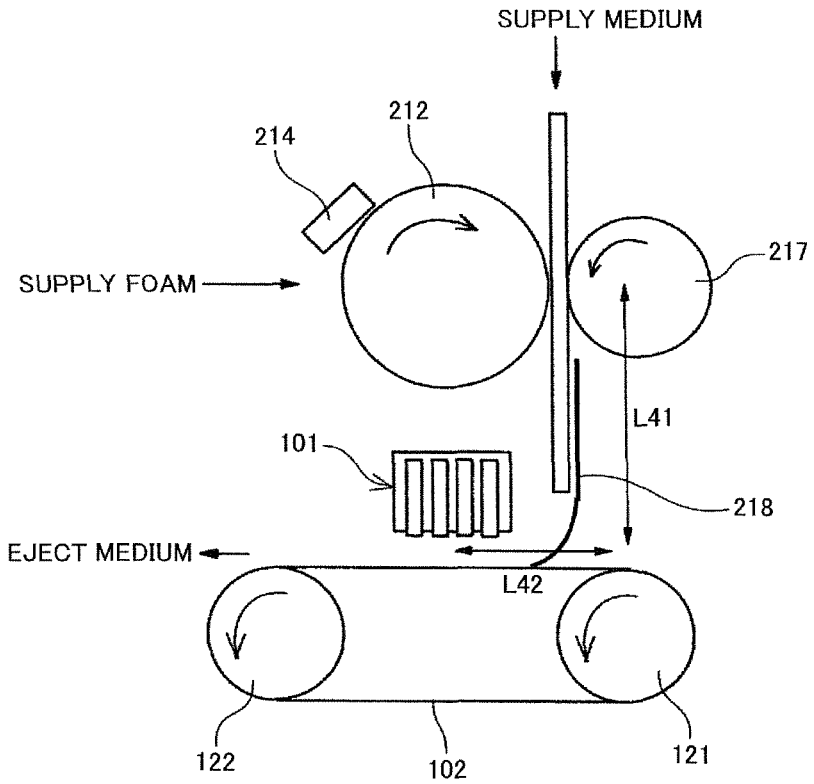
FIG. 20 is a diagram showing an important part of the image forming apparatus in a third embodiment of the present invention.

Next, a description will be given of an image forming apparatus in a third embodiment of the present invention, by referring to FIG. 20. FIG. 20 is a diagram showing an important part of the image forming apparatus in this third embodiment of the present invention. In FIG. 20, those parts that are the same as those corresponding parts in FIG. 1 are designated by the same reference numerals, and a description thereof will be omitted.

In the image forming apparatus shown in FIG. 20, the coating roller 212 is arranged above the transport belt 102. A transport roller 217 is arranged to confront the coating roller 212. A guide member 218 guides the recording medium 100, which is fed from between the coating roller 212 and the transport roller 217, onto the transport belt 102.

The coating roller 212, and the transport path formed by the transport belt 102 which transports the recording medium 100 to the coating position of the coating roller 212 are arranged with a positional relationship such that the coating position is located beside (on the side of) the coating roller 212 in the horizontal direction which is perpendicular to the vertical direction. The transport path transports the recording medium 100 from above the coating position of the coating roller 212 in the vertical direction.

In this third embodiment, a distance from the coating position of the foam 210 by the coating roller 212 to the print position of the recording head unit 101 is [L41+L42] in FIG. 20, and this distance is shorter than the distance from the coating position of the foam 210 by the coating roller 212 to the print position of the recording head unit 101 of the first embodiment shown in FIG. 1. The distance [L41+L42] is set to a distance such that the moisture in the ink penetration depth range at the surface of the recording medium 100 can be reduced to a level which will not cause picture quality deterioration (spreading), and if necessary, taking into consideration the drying speed of the foam 210.

Therefore, the size of the image forming apparatus can be reduced by setting the positional relationship between the coating roller 212 and the transport path which transports the recording medium 100 to the coating position of the coating roller 212 so that the coating position is located at a position above the transport belt 102 in the vertical direction.

Figure 21:
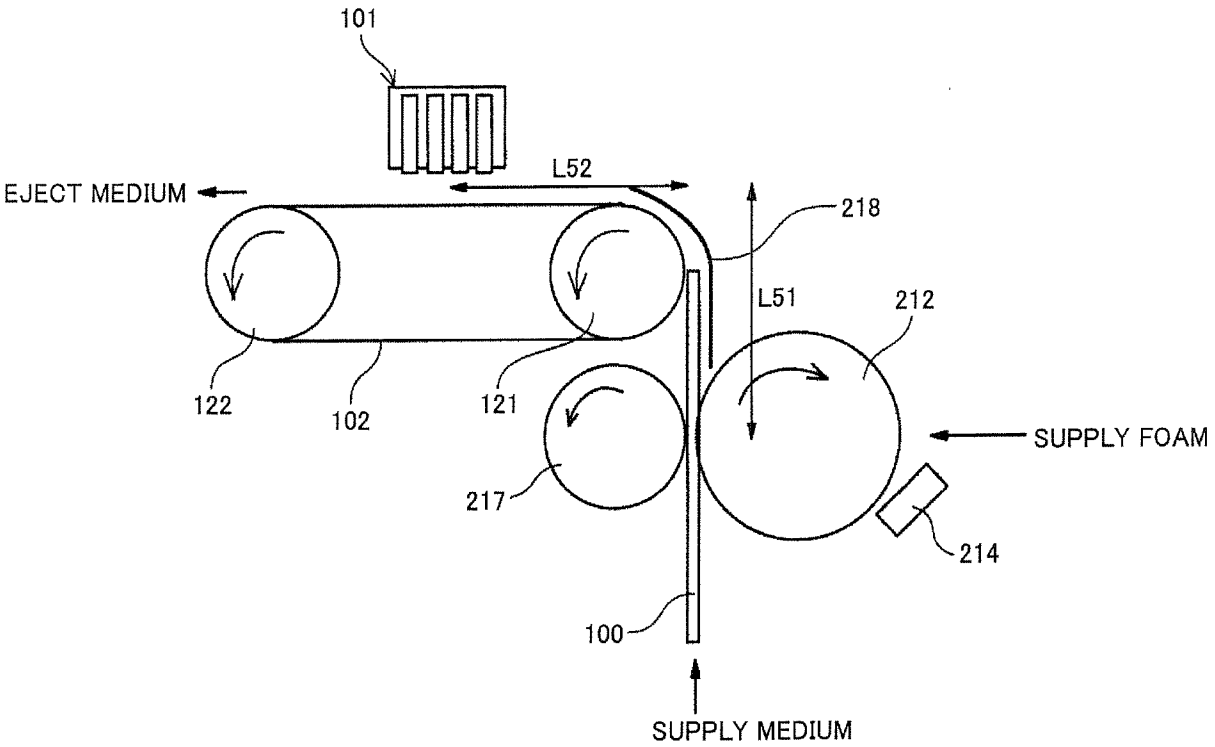
FIG. 21 is a diagram showing an important part of the image forming apparatus in a fourth embodiment of the present invention.

Next, a description will be given of an image forming apparatus in a fourth embodiment of the present invention, by referring to FIG. 21. FIG. 21 is a diagram showing an important part of the image forming apparatus in this fourth embodiment of the present invention. In FIG. 21, those parts that are the same as those corresponding parts in FIG. 1 are designated by the same reference numerals, and a description thereof will be omitted.

In the image forming apparatus shown in FIG. 21, the coating roller 212 is arranged below to the right of the transport belt 102. A transport roller 217 is arranged to confront the coating roller 212. A guide member 218 guides the recording medium 100, which is fed from between the coating roller 212 and the transport roller 217, onto the transport belt 102.

The coating roller 212, and the transport path formed by the transport belt 102 which transports the recording medium 100 to the coating position of the coating roller 212 are arranged with a positional relationship such that the coating position is located beside (on the side of) the coating roller 212 in the horizontal direction which is perpendicular to the vertical direction. The transport path transports the recording medium 100 from below the coating position of the coating roller 212 in the vertical direction.

In this fourth embodiment, a distance from the coating position of the foam 210 by the coating roller 212 to the print position of the recording head unit 101 is [L51+L52] in FIG. 21, and this distance is shorter than the distance from the coating position of the foam 210 by the coating roller 212 to the print position of the recording head unit 101 of the first embodiment shown in FIG. 1. The distance [L51+L52] is set to a distance such that the moisture in the ink penetration depth range at the surface of the recording medium 100 can be reduced to a level which will not cause picture quality deterioration (spreading), and if necessary, taking into consideration the drying speed of the foam 210.

Therefore, the size of the image forming apparatus can be reduced by setting the positional relationship between the coating roller 212 and the transport path which transports the recording medium 100 to the coating position of the coating roller 212 so that the coating position is located at a position below the transport belt 102 in the vertical direction.

If the user specifies the print mode by the printer driver of the host computer when coating the foam (or foam setting agent) 210 on the recording medium 100, information related to this print mode is supplied to the CPU 801 via the communication control unit 812 and the communication control part 813, and is thereafter managed within the ROM 802. The print mode may specify the kind or type of recording medium 100 to be used, the printing speed, the picture quality and the like. By referring to a table which indicates the correspondence between the print mode and the linear velocity of the printing, it is possible to control the I/O control part 807, the various motors 806, the print control part 811 and the plotter part 810, so that the linear velocity of the recording medium 100, that is, the transport velocity of the recording medium 100, is suited for obtaining the picture quality in which the moisture in the ink penetration depth range at the surface of the recording medium 100 is reduced to a level which will not cause picture quality deterioration (spreading).

In the embodiments described above, the foam transport passage 233 transports and supplies the generated foam 210 towards the coating roller 212 by the accumulation force of the foam 210. However, the foam 210 may be transported and supplied towards the coating roller by the accumulation force of the foam 210 and another transport force, as described hereunder with reference to FIG. 22.

Figure 22:
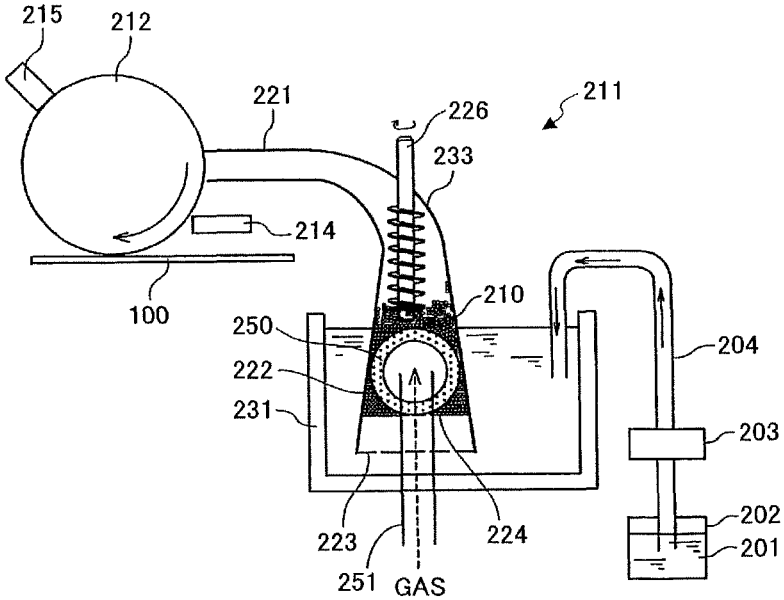
FIG. 22 is a diagram showing a further example of the foam coating apparatus.

FIG. 22 is a diagram showing a further example of the foam coating apparatus. In FIG. 22, those parts that are the same as those corresponding parts in FIG. 5 are designated by the same reference numerals, and a description thereof will be omitted.

As shown in FIG. 22, in the foam generating apparatus 211, a screw member 226 which rotates in the direction of an arrow is provided as a means of applying a transport force other than the accumulation force of the foam 210. This screw member 226 is arranged above the porous member 250, that is, on the downstream side of the foam generating mechanism. By rotating this screw member 226, it is possible to more smoothly transport the foam 210 within the foam transport passage 233 towards the downstream side. For the sake of convenience, the foam 210 within the foam transport passage 233 is not shown in FIG. 22, but the foam 210 is also transported by the accumulation force of the foam 210 itself, as described above.

If the screw member 226 is to be provided in the foam generating apparatus 211 shown in FIG. 8, the screw member 226 may be provided above the agitating mechanism 232 in FIG. 8, that is, on the downstream side of the foam generating mechanism.

In the embodiments described above, the foam coating apparatus coats the foam on the recording medium prior to the image formation on the recording medium. However, the foam coating apparatus may be arranged on the downstream size of the recording head unit along the transport direction of the recording medium, in order to coat the foam on the recording medium after the image formation on the recording medium. In addition, although the embodiments described above generate the foam from the liquid which may be formed into the foam state, it is possible to generate the foam from a gel which may be formed into the foam state (foam gel). In other words, the present invention is similarly applicable to a generating apparatus which generates the foam from the gel, a coating apparatus which coats such foam, and an image forming apparatus which uses such a coating apparatus.

The coating apparatus which coats the foam on the recording medium may also be applied to the electrophotography type image forming apparatus, for example. When the foam, which is a (foam) fixing agent, is coated on the recording medium on which resin particles including toner and the like have already been adhered, it is possible to quickly fix the resin particles on the recording medium without disturbing the resin particles. It is also possible to apply the present invention to a fixing method, a fixing unit, an image forming method and an image forming apparatus which uses a fixing liquid (agent) of resin particles that enable an extremely small amount of the fixing liquid to be coated on the recording medium to such an extent that no oily residue is detectable on the recording medium.

Figure 23A:
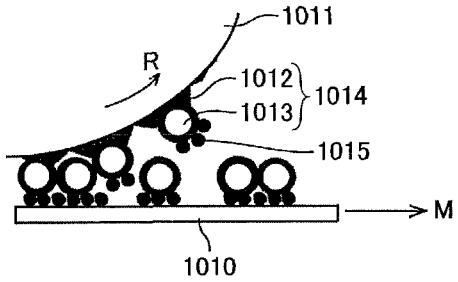
FIGS. 23A and 23B are diagrams, on an enlarge scale, for explaining a portion where a roller coating surface and non-fixed resin particles make contact, in a state where a relatively high pressure is applied at a contact surface between a coating roller and a recording medium, in a case where the present invention is applied to an electrophotography type image forming apparatus.
Figure 23B:
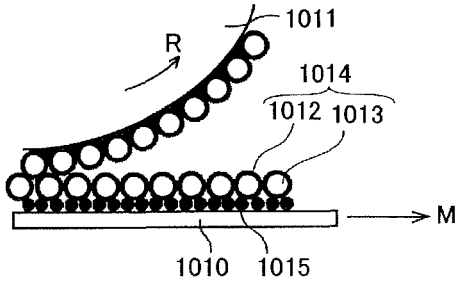
Figure 24A:
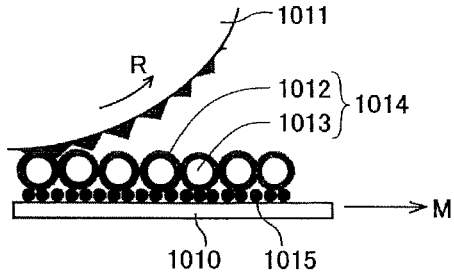
FIGS. 24A and 24B are diagrams, on an enlarge scale, for explaining the portion where the roller coating surface and the non-fixed resin particles make contact, in a state where a relatively low pressure is applied at the contact surface between the coating roller and the recording medium, in the case where the present invention is applied to the electrophotography type image forming apparatus.
Figure 24B:
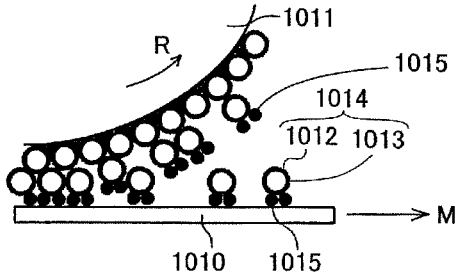

Next, a description will be given of an electrophotography type image forming apparatus which is applied with the present invention, by referring to FIGS. 23A, 23B, 24A and 24B which show enlarged views of a portion where a roller coating surface and non-fixed resin particles make contact at a roller coating mechanism (or roller coating means). FIGS. 23A and 23B are diagrams, on an enlarge scale, for explaining the portion where the roller coating surface and the non-fixed resin particles make contact, in a state where a relatively high pressure is applied at a contact surface between the coating roller and the recording medium, in a case where the present invention is applied to the electrophotography type image forming apparatus. FIGS. 24A and 24B are diagrams, on an enlarge scale, for explaining the portion where the roller coating surface and the non-fixed resin particles make contact, in a state where a relatively low pressure is applied at the contact surface between the coating roller and the recording medium, in the case where the present invention is applied to the electrophotography type image forming apparatus. It is assumed in each of FIGS. 23A, 23B, 24A and 24B that a coating roller 1011 rotates in a direction R indicated by an arrow, and a recording medium 1010 moves (or is transported) in a direction M indicated by an arrow.

In the case where the applied pressure at the contact surface between the coating roller 1011 and the recording medium 1010 is relatively high, a foam fixing liquid 1012 has a single-layer (or monolayer) structure made up of bubbles 1013 on the coating surface of the coating roller 1011 as shown in FIG. 23A. It is assumed for the sake of convenience that the bubble diameter is the same in FIGS. 23A, 23B, 24A and 24B. Hence, the film thickness of the foam fixing liquid 1012 on the recording medium 1010 can be made thinner in FIG. 23A than in FIG. 23B. However, as shown in FIG. 23A, because the bubbles 1013 forms the single-layer structure, the bubbles 1013 themselves easily adhere onto the coating surface of the coating roller 1011 due to surface tension, and the foam fixing liquid 1012 is not coated uniformly on resin particles (non-fixed toner) 1015 on the recording medium 101. Consequently, the resin particles 1015 adhere onto the bubbles 1013 and generates a toner offset on the coating surface of the coating roller 1011.

On the other hand, if the foam fixing liquid 1012 on the coating surface of the coating roller 1011 has a multi-layer structure made up of the bubbles 1013 as shown in FIG. 23B, it is possible to embed the bubbles 1013 into the surface of the resin particles (non-fixed toner) 1015 having undulations. Hence, the foam fixing liquid 1012 more easily separates between the layers of the bubbles 1013. As a result, it is possible to coat the foam fixing liquid 1012 uniformly on the resin particles (non-fixed toner) 1015, and a toner offset is unlikely generated on the coating surface of the coating roller 1011.

Accordingly, when the applied pressure at the contact surface between the coating roller 1011 and the recording medium 1010 is relatively high, it is desirable to take measures so that the toner offset will not be generated by the resin particles (non-fixed toner) 1015 on the coating roller 1011. More particularly, the toner offset can be prevented by measuring in advance the average size (bubble diameter) of the bubbles 1013 that are generated, and controlling the film thickness of the foam fixing liquid 1012 on the coating roller 1011 to a thickness corresponding to a plurality of layers of the bubbles 1013, in order to positively make the foam fixing liquid 1012 have the multi-layer structure made up of the bubbles 1013.

On the other hand, in the case where the applied pressure at the contact surface between the coating roller 1011 and the recording medium 1010 is relatively low, the foam fixing liquid 1012 on the coating surface of the coating roller 1011 has the single-layer structure made up of the bubbles 1013 as shown in FIG. 24A. For this reason, the bubbles 1013 easily adhere to the surface of the resin particles (non-fixed toner) 1015 having undulations. Consequently, the layer of the bubbles 1013 separates from the coating surface of the coating roller 1011, and the foam fixing liquid 1012 is coated on the resin particles (non-fixed toner) 1015.

If the foam fixing liquid 1012 on the coating surface of the coating roller 1011 has the multi-layer structure made up of the bubbles 1013 as shown in FIG. 24B, the bonding among the bubbles 1013 is strong, and the bubbles 1013 tend to remain on the coating roller 1011. Further, the resin particles (non-fixed toner) 1015 tend to adhere to the bubbles 1013, and generates a toner offset on the coating surface of the coating roller 1011.

Therefore, when the applied pressure at the contact surface between the coating roller 1011 and the recording medium 101 is relatively low, the toner offset can be prevented by measuring in advance the average size (bubble diameter) of the bubbles 1013 that are generated, and controlling the film thickness of the foam fixing liquid 1012 on the coating roller 1011 to a thickness corresponding to a single layer of the bubbles 1013, in order to positively make the foam fixing liquid 1012 have the single-layer structure made up of the bubbles 1013. In other words, the toner offset can be presented under the high-pressure conditions described above in conjunction with FIGS. 23A and 23B. In addition, in order to prevent the toner offset of the resin particles (non-fixed toner) 1015 on the coating roller 1011, it is preferable to control the film thickness of the foam fixing liquid 1012 to a range which does not cause fluidity of the bubbles 1013, because if the layer of the bubbles 1013 on the coating roller 1011 is too thick, the fluidity of the bubbles 1013 occurs at the contact portion between the coating roller 1011 and the recording medium 1010.

By controlling the film thickness of the foam fixing liquid depending on the size of the bubbles included in the foam fixing liquid and the applied pressure at the contact surface between the coating roller and the recording medium, it is possible to prevent the toner offset on a contacting and coating mechanism (or contacting and coating means), such as the coating roller, and to prevent the image distortion, and enable the fixing to be made by coating an extremely small amount of the foam fixing liquid.

Therefore, it is possible to use a softening agent to soften the resin particles by dissolving or swelling at least a portion of the resin particles, and to fix the resin particles on the recording medium using the contacting and coating mechanism to coat the fixing liquid on the resin particles. When applying the fixing liquid on the resin particles on the surface of the recording medium, the fixing liquid has the foam state including bubbles. Further, by controlling the applied pressure at the contacting surface between the contacting and coating mechanism, such as the coating roller, and the recording medium, depending on the film thickness of the foam fixing liquid, it is possible to prevent the toner offset on the coating roller and to prevent the image distortion. The fixing can be carried out by coating an extremely small amount of fixing liquid on the resin particles on the recording medium. Moreover, the present invention is very effective when the resin particles are the toner particles used by the electrophotography technique. The toner offset on the fixing roller and the image distortion can be prevented, by controlling the film thickness of the foam fixing liquid depending on the film thickness of the resin particles (or toner particles).

This application claims the benefit of Japanese Patent Applications No. 2007-238823 filed Sep. 14, 2007 and No. 2008-226487 filed Sep. 3, 2008, in the Japanese Patent Office, the disclosures of which are hereby incorporated by reference.

Further, the present invention is not limited to these embodiments, but various variations and modifications may be made without departing from the scope of the present invention.

The invention claimed is:

1. An image forming apparatus comprising:

a generating mechanism configured to generate foam from a liquid or gel which may take a foam state;

a coating roller, having a peripheral surface supplied with the foam, and configured to coat the foam on the peripheral surface onto a surface of a recording medium; and a transport passage within which the foam generated by the generating mechanism accumulates, wherein the generating mechanism includes an agitating mechanism configured to agitate the liquid or gel, and the accumulating foam within the transport passage is transported to the coating roller solely by an accumulation force due to an increase in volume of the accumulating foam as the liquid or gel is transformed into the foam state by the agitating mechanism, the transport of the foam towards the coating roller is controlled by an agitating state and a stopped state of the agitating mechanism, and in the agitating state of the agitating mechanism, the foam is transported towards the coating roller by the accumulating force alone, and on the other hand, in the stopped state of the agitating mechanism, the accumulation force stops and thus the transport of the foam is stopped, and wherein the accumulating force alone, without another transport mechanism other than the transport passage, carries the accumulating foam through the passage towards the coating roller.

2. The image forming apparatus as claimed in claim 1, further comprising:

a thickness restricting mechanism configured to restrict a film thickness of the foam on the peripheral surface of the coating roller.

3. The image forming apparatus as claimed in claim 1, further comprising:

a restricting mechanism configured to restrict a region on the peripheral surface of the coating roller where the foam is supplied.

4. The image forming apparatus as claimed in claim 1, further comprising:

a heater configured to heat the recording medium.

5. The image forming apparatus as claimed in claim 1, further comprising:

a control part configured to enable or disable coating of the foam by the coating roller based on a picture quality of an image to be formed on the recording medium.

6. The image forming apparatus as claimed in claim 1, further comprising:

a transport path configured to transport the recording medium to a coating position where the coating roller coats the foam onto the recording medium, wherein the coating roller and the transport path are arranged with a positional relationship such that the coating position is located at a position other than below the coating roller in a vertical direction.

7. The image forming apparatus as claimed in claim 1, further comprising:

a transport path configured to transport the recording medium to a coating position where the coating roller coats the foam onto the recording medium, wherein the coating roller and the transport path are arranged with a positional relationship such that the coating position is located at a position above the coating roller in a vertical direction.

8. The image forming apparatus as claimed in claim 1, further comprising:

a transport path configured to transport the recording medium to a coating position where the coating roller coats the foam onto the recording medium, wherein the coating roller and the transport path are arranged with a positional relationship such that the coating position is located at a position beside the coating roller in a horizontal direction.

9. The image forming apparatus as claimed in claim 8, wherein the transport path transports the recording medium from above the coating position of the coating roller in a vertical direction.

10. The image forming apparatus as claimed in claim 8, wherein the transport path transports the recording medium from under the coating position of the coating roller in a vertical direction.

11. The image forming apparatus as claimed in claim 6, further comprising:

a control part configured to control a transport velocity of the recording medium when the coating roller coats the foam on the recording medium, based on a picture quality of an image to be formed on the recording medium.

12. An apparatus for coating foam on a coating target member, comprising:

a generating mechanism configured to generate foam from a liquid or gel which may take a foam state;

a coating roller, having a peripheral surface supplied with the foam, and configured to coat the foam on the peripheral surface onto a surface of the coating target member; and a transport passage within which the foam generated by the generating mechanism accumulates, wherein the generating mechanism includes an agitating mechanism configured to agitate the liquid or gel, and the accumulating foam within the transport passage is transported to the coating roller solely by an accumulation force due to an increase in volume of the accumulating foam as the liquid or gel is transformed into the foam state by the agitating mechanism, and the transport of the foam towards the coating roller is controlled by an agitating state and a stopped state of the agitating mechanism, and in the agitating state of the agitating mechanism, the foam is transported towards the coating roller by the accumulating force alone, and on the other hand, in the stopped state of the agitating mechanism, the accumulation force stops and thus the transport of the foam is stopped, and wherein the accumulating force alone, without another transport mechanism other than the transport passage, carries the accumulating foam through the passage towards the coating roller.

13. The apparatus as claimed in claim 12, further comprising:

a thickness restricting mechanism configured to restrict a film thickness of the foam on the peripheral surface of the coating roller.

14. The apparatus as claimed in claim 12, further comprising:

a restricting mechanism configured to restrict a region on the peripheral surface of the coating roller where the foam is supplied.

15. An image forming apparatus comprising:

a generating mechanism configured to generate foam from a liquid or gel which may take a foam state;

a coating roller, having a peripheral surface supplied with the foam, and configured to coat the foam on the peripheral surface onto a surface of a recording medium; and a transport passage within which the foam generated by the generating mechanism accumulates, wherein the generating mechanism includes an agitating mechanism configured to agitate the liquid or gel, and the accumulating foam within the transport passage is transported to the coating roller by an accumulation force due to an increase in volume of the accumulating foam as the liquid or gel is transformed into the foam state by the agitating mechanism, and the accumulating force alone, without another transport mechanism, carries the accumulating foam through the passage towards the coating roller, and the transport of the foam towards the coating roller is controlled by an agitating state and a stopped state of the agitating mechanism, and in the agitating state of the agitating mechanism, the foam is transported towards the coating roller by the accumulating force alone, and on the other hand, in the stopped state of the agitating mechanism, the accumulation force stops and thus the transport of the foam is stopped, and wherein the accumulating force alone, without another transport mechanism other than the transport passage, carries the accumulating foam through the passage towards the coating roller.

* * * * *